US005829074A

United States Patent [19]

Fisher

[11] Patent Number: 5,829,074

[45] Date of Patent: Nov. 3, 1998

[54] STRUCTURE FOR BEARING WEIGHT

[76] Inventor: Carol J. Fisher, 12 Laurel Dr., Millbury, Mass. 01527

[21] Appl. No.: 696,525

[22] Filed: Aug. 14, 1996

[51] Int. Cl.[6] ..... A47C 19/00

[52] U.S. Cl. ..... 5/9.1; 5/8; 5/2.1

[58] Field of Search ..... 5/9.1, 8, 2.1, 53.1, 5/280, 281, 288, 292, 299, 305, 200.1, 201, 282.1, 285, 286; 403/172, 173, 174, 175; 52/730.4

[56] References Cited

U.S. PATENT DOCUMENTS

| | | | |
|---|---|---|---|
| D. 271,826 | 12/1983 | Hull . | |
| D. 271,827 | 12/1983 | Hull . | |
| D. 277,433 | 2/1985 | Hull | D6/384 |
| D. 292,456 | 10/1987 | Wycoff | D6/389 |
| D. 325,825 | 5/1992 | Bell . | |
| D. 346,076 | 4/1994 | Brunel . | |
| D. 381,830 | 8/1997 | Fisher | D6/383 |
| 2,528,307 | 10/1950 | Heaney . | |
| 3,316,564 | 5/1967 | Rogers, Jr. | D6/384 X |
| 4,176,753 | 12/1979 | Godfrey | 211/182 |
| 4,232,411 | 11/1980 | Speyer . | |
| 4,361,919 | 12/1982 | Hull | 5/2.1 |
| 4,398,841 | 8/1983 | Kojima et al. | 403/173 |
| 5,003,650 | 4/1991 | Caya . | |
| 5,182,824 | 2/1993 | Cipriano | 5/2.1 |

*Primary Examiner*—Brian K. Green
*Assistant Examiner*—Fredrick Conley
*Attorney, Agent, or Firm*—Blodgett & Blodgett, P.C.

[57] ABSTRACT

A structure for bearing weight is disclosed which has a plurality of upwardly directed, horizontally spaced, hollow, elongated support posts, each with a sidewall. A first and a second generally horizontal beam, which are coplanar and horizontally spaced, extend between a first and a second pair of posts, respectively, and intersect their respective sidewalls. At least two parallel, spaced, coplanar joists are each supported by both of the beams. A first and a second generally horizontal, hollow, elongated support member is positioned parallel to and adjacent the first and second beam, respectively, and extends between and abuts the first and second pair of posts, respectively. Each of the support members has a sidewall, and at least one of the sidewall of each the support members and the pair of posts between which it extends, provides a group at least two apertures. Each aperture receives a portion of one of the joists to allow each joist to be supported by both beams. First and second retaining means retains the first and second support members in rigid contact with the first and second pair of posts, respectively. The structure for bearing weight may be configured as a fill bed. With the addition of a third and fourth beam, a third and fourth support member, third and fourth retaining means and another group of at least two coplanar joists, the structure may be configured as a bunk bed.

39 Claims, 13 Drawing Sheets

STRUCTURE FOR BEARING WEIGHT

BACKGROUND OF THE INVENTION

The field of invention relates generally to a structure for bearing weight, and more particularly, pertains to a bunk bed structure.

Bunk bed structures, as currently known, are formed of metal that is welded together, or else of wood that is held together with conventional fasteners such as bolts or wing nuts. The metal frame welds have the potential to become fatigued and fail over time. Moreover, the wood fasteners may gradually loosen and separate over time, either condition creating a dangerous situation, given the height of the top bed.

Furthermore, since children love to play on and around a bunk bed structure, there is a further danger of injury from protruding fasteners.

Another consideration with bunk beds is that the owner must either purchase expensive pre-formed parts, or else spend considerable time in designing and preparing the parts. Moreover, additional time is spent in relatively extensive subsequent assembly involving the use of a significant number of tools and fasteners.

None of the bunk beds of the prior art deal with the above cited difficulties to any significant extent. They either require considerable expense, or considerable expenditure of time in their construction. However, these and other difficulties experienced with the prior art devices have been obviated in a novel manner by the present invention.

It is, therefore, a principal object of the invention to provide a novel structure for bearing weight which provides for a more reliable joinder between its various components.

Another object of this invention is the provision of a novel structure for bearing weight which does not offer dangerous protrusions.

A further object of the present invention is the provision of a novel structure for bearing weight which may be fabricated from readily available and easily formed components.

It is another object of the instant invention to provide a novel structure for bearing weight which may be assembled without the use of tools, and through using few, if any fasteners.

It is a further object of the present invention to provide a structure for bearing weight which is simple in construction, inexpensive to manufacture, and capable of a long life of useful service with a minimum of maintenance.

SUMMARY OF THE INVENTION

It has now been found that the foregoing and related objects may be readily attained in a structure for bearing weight having an upwardly directed, hollow, elongated support post with a sidewall. The structure further provides a generally horizontal beam intersecting the sidewall of the post and, a joist, supported at least in part by the beam.

A generally horizontal, hollow, elongated support member is positioned parallel to and adjacent the beam and abutting the post. The beam and the support member may either be configured with the beam external to the support member and the support member overlaying at least a portion of the beam, or with the support member surrounding at least a portion of the beam.

The support member has a sidewall, and at least one of the sidewall of the support member and the sidewall of the post prove an aperture to receive a portion of the joist, to allow the joist to be supported at least in part by the beam.

Preferably the post and the support member are tubular, and the post is generally vertical.

In a preferred embodiment, the structure for bearing weight further comprises an elongated weight distribution member positioned beneath the beam, in contact therewith and parallel thereto to support at least a portion of the weight thereof. The weight distribution member intersects the sidewall of the post. In this embodiment, the beam and the weight distribution member may be integral, and the sidewall of the post is intersected twice by the beam.

In a preferred embodiment, the structure for bearing weight comprises a plurality of upwardly directed, horizontally spaced, hollow, elongated support posts, each of which has a sidewall. A first generally horizontal beam extends between a first pair of the plurality of posts and intersects the sidewalls thereof with the first beam having a pair of ends. A second generally horizontal beam extends between a second pair of the plurality of posts and intersecting the sidewalls thereof with the second beam having a pair of ends. The first beam and the second beam are coplanar and horizontally spaced.

At least two parallel, spaced, coplanar joists are each supported by both of the first beam and the second beam.

A first generally horizontal, hollow, elongated support member is positioned parallel to and adjacent the first beam and extends between and abuts the first pair of posts. The first beam and the first support member may either be configured with the first beam external to the first support member and the first support member overlaying at least a portion of the first beam, or with the first support member surrounding at least a portion of the first beam.

The first support member has a sidewall, and at least one of the sidewall of the first support member and the sidewalls of the first pair of posts provide a first group of at least two apertures. Each aperture of the first group of apertures receives a portion of one of the joists to allow it to be supported at least in part by the first beam.

Similarly, a second generally horizontal, hollow, elongated support member is positioned parallel to and adjacent the second beam and extends between and abuts the second pair of posts. The second beam and the second support member may either be configured with the second beam external to the second support member and the second support member overlaying at least a portion of the second beam, or with the second support member surrounding at least a portion of the second beam.

The second support member has a sidewall and at least one of the sidewall of the second support member and the sidewalls of the second pair of posts provides a second group of at least two apertures. Each aperture of the second group of apertures receives a portion of one of the joists to allow the joist to be supported at least in part by the second beam.

A first retaining means, which is preferably a first strap circumscribing the first support member and the first pair of posts, retains the first support member in rigid contact with the first pair of posts. Similarly, a second retaining means, which is preferably a second strap circumscribing the second support member and the second pair of posts, retains the second support member in rigid contact with the second pair of posts.

Preferably, the plurality of posts, the first support member and the second support member are tubular, with the plurality of posts being positioned generally vertically, and with the first beam and the second beam being positioned parallel to each other and in a generally horizontal plane. The joists lie in a plane which is generally parallel to the generally horizontal plane in which the first beam and the second beam lie.

Optionally, the structure for bearing weight may have an elongated weight distribution member positioned beneath each end of the first beam, in contact with and parallel to it, to support at least a portion of its weight. An elongated weight distribution member is also positioned beneath each end of the second beam, in contact with and parallel to it to support at least a portion of its weight. Each of the weight distribution members in contact with the first beam intersects the sidewall of at least one of the first pair of posts, and each of the weight distribution members in contact with the second beam intersects the sidewall of at least one of the second pair of posts. Preferably, the first beam and each of the weight distribution members in contact with it are integral, as are the second beam and each of the weight distribution members in contact with it.

Preferably, each of the sidewalls of the first pair of posts is intersected twice by the first beam, and each of the sidewalls of the second pair of posts is intersected twice by the second beam, and the joists are dimensioned and configured to operatively support a bed mattress.

In the preferred embodiment, each of the posts has a lower end and an upper end, and the first beam extends between the first pair of posts adjacent their lower ends, with the second beam extending between the second pair of posts adjacent their lower ends. The parallel joists are lower parallel joists, and each of the apertures receives a portion of one of the lower parallel joists.

A third generally horizontal beam extends between a pair of the posts, adjacent their upper ends, and intersects their sidewalls, and a fourth generally horizontal beam extends between a pair of the posts, adjacent their upper ends, and intersects their sidewalls. The third beam and the fourth beam are coplanar and horizontally spaced.

At least two parallel, spaced, coplanar upper joists are dimensioned and configured to operatively support a bed mattress, and are each supported by both of the third beam and the fourth beam.

A third generally horizontal hollow, elongated support member is positioned parallel to and adjacent the third beam and extends between and abuts the pair of posts between which the third beam extends. The third beam and the third support member may either be configured with the third beam external to the third support member and the third support member overlaying at least a portion of the third beam, or with the third support member surrounding at least a portion of the third beam.

The third support member has a sidewall, and at least one of the sidewall of the third support member and the sidewalls of the pair of posts between which it extends provides a third group of at least two apertures. Each aperture of the third group of apertures receives a portion of one of the upper joists to allow it to be supported at least in part by the third beam.

A fourth generally horizontal, hollow, elongated support member is positioned parallel to and adjacent the fourth beam and extends between and abuts the pair of posts between which the fourth beam extends. The fourth beam and the fourth support member may either be configured with the fourth beam external to the fourth support member and the fourth support member overlaying at least a portion of the fourth beam, or with the fourth support member surrounding at least a portion of the fourth beam.

The fourth support member has a sidewall, and at least one of the sidewall of the fourth support member and the sidewalls of the pair of posts between which it extends provides a fourth group of at least two apertures. Each aperture of the fourth group of apertures receives a portion of one of the upper joists to allow it to be supported at least in part by the fourth beam.

A third retaining means, which is preferably a third strap circumscribing the third support member and the pair of posts between which it extend, retains the third support member in rigid contact with the pair of posts between which it extends. Similarly, a fourth retaining means, which is preferably a fourth strap circumscribing the fourth support member and the pair of posts between which it extends, retains the fourth support member in rigid contact with the pair of posts between which it extends.

In the preferred embodiment, the sidewall of the third support member and the sidewall of the fourth support member each have an inner surface, and the third beam and the fourth beam each have an upper surface. A first spacer block extends from the inner surface of the sidewall of the third support member to the upper surface of the third beam The first spacer block intersects at least one of the sidewalls of the pair of posts between which the third support member extends, with the first spacer block being to limit the radial movement of the third support member relative to the third beam. Similarly, a second spacer block extends from the inner surface of the sidewall of the fourth support member to the upper surface of the fourth beam, and intersects at least one of the sidewalls of the pair of posts between which the fourth support member extends. Analogously, the second spacer block is to limit the radial movement of the fourth support member relative to the fourth beam It should be noted that the elements of each of the above embodiments may be provided in kit form for assembly by the user.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
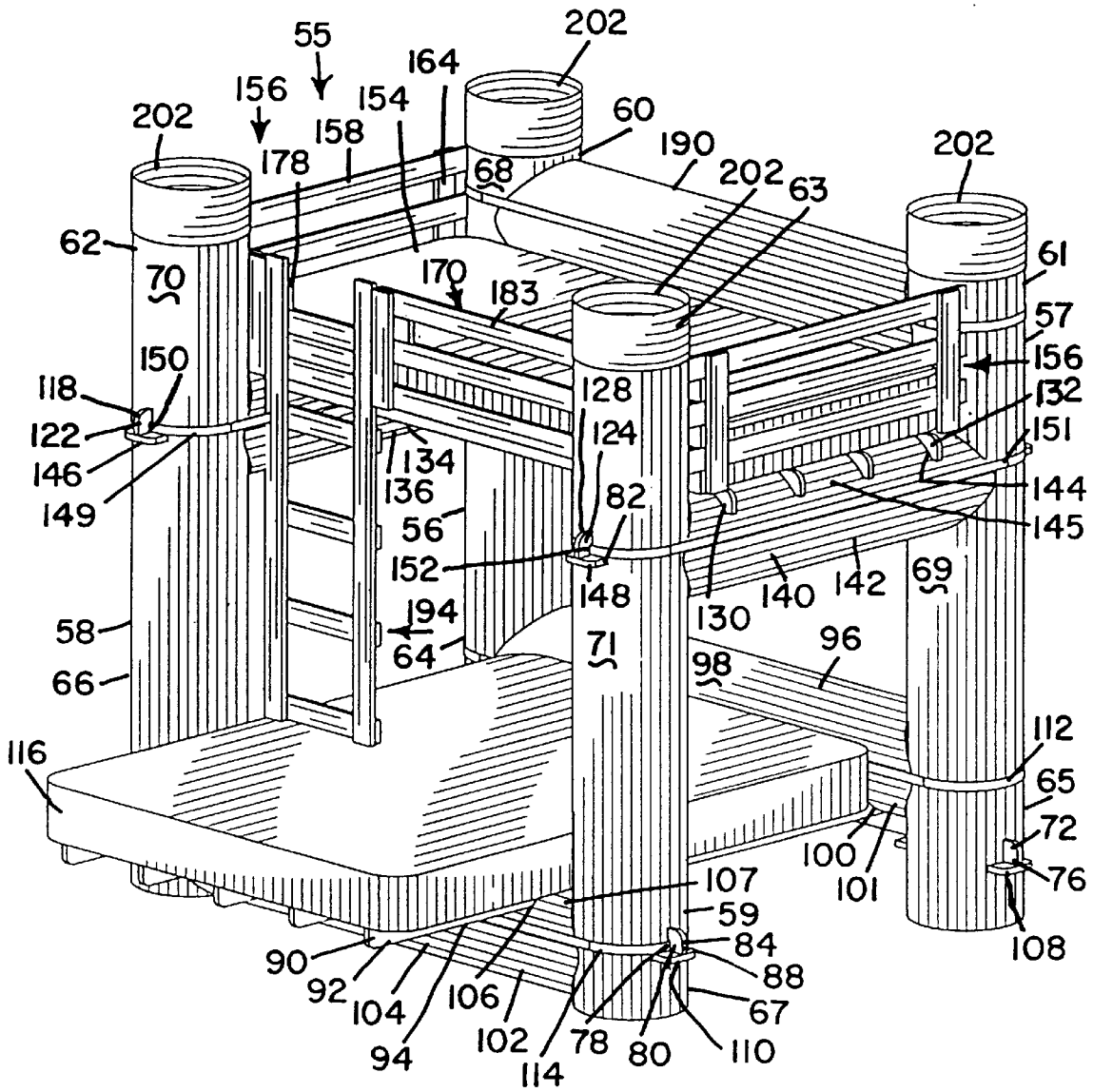
FIG. 1 is a perspective view of a structure for bearing weight, embodying the principals of the present invention.
Figure 2:
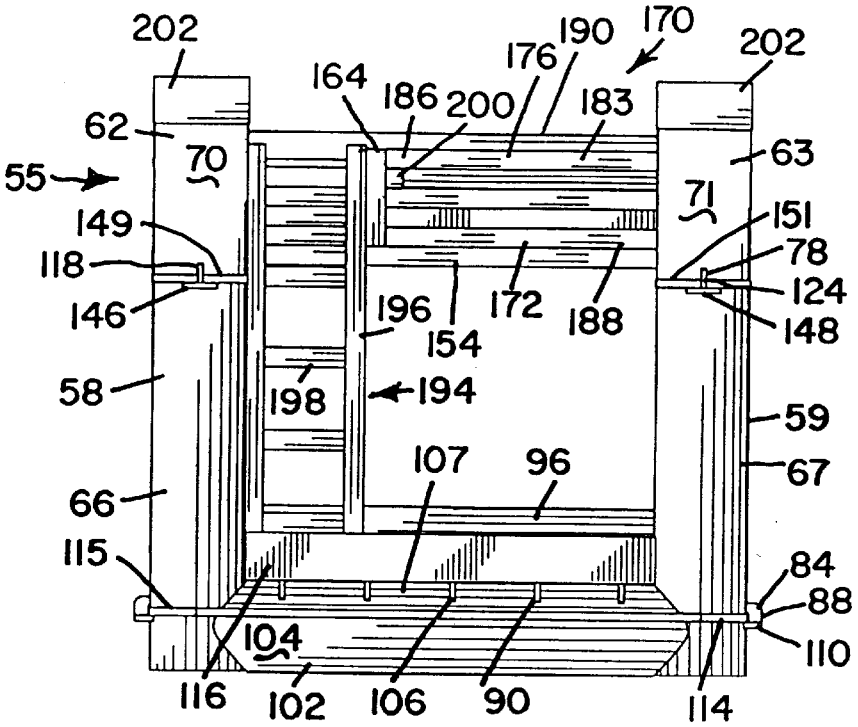
FIG. 2 is a front elevational view, drawn to a reduced scale, of the structure for bearing weight of FIG. 1.
Figure 3:
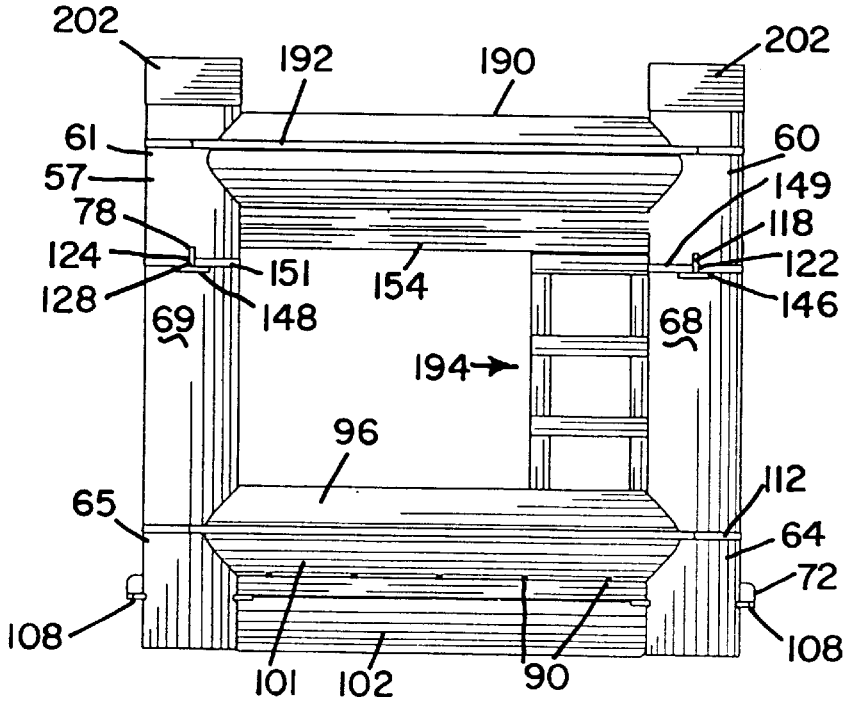
FIG. 3 is a rear elevational view, drawn to a reduced scale, of the structure for bearing weight of FIG. 1.
Figure 4:
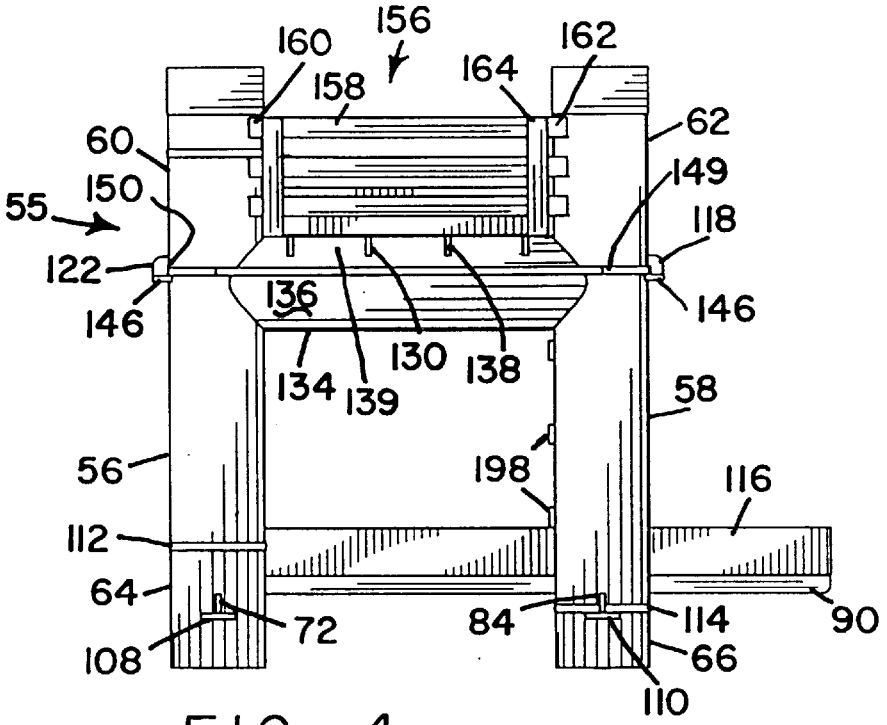
FIG. 4 is a side elevational view, drawn to a reduced scale, of the structure for bearing weight of FIG. 1.
Figure 5:
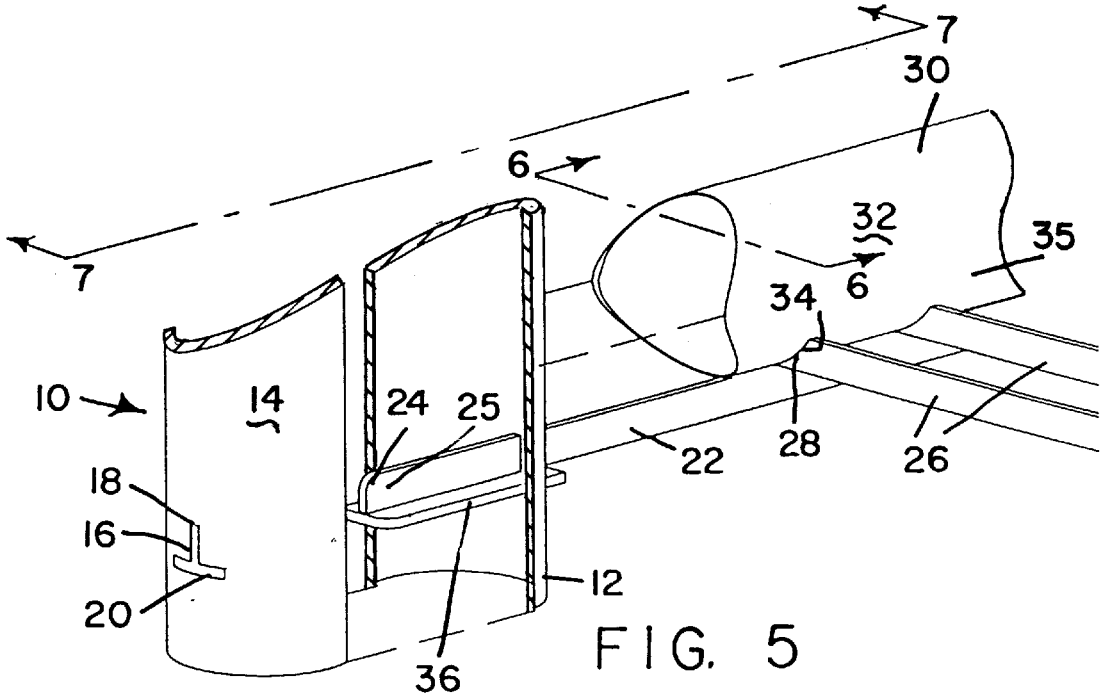
FIG. 5 is an exploded perspective view, in enlarged scale, of another embodiment of a structure for bearing weight, embodying the principles of the present invention and showing the post sectioned and broken away to show detail, with the beam, joists, post and support member in fragment.
Figure 6:
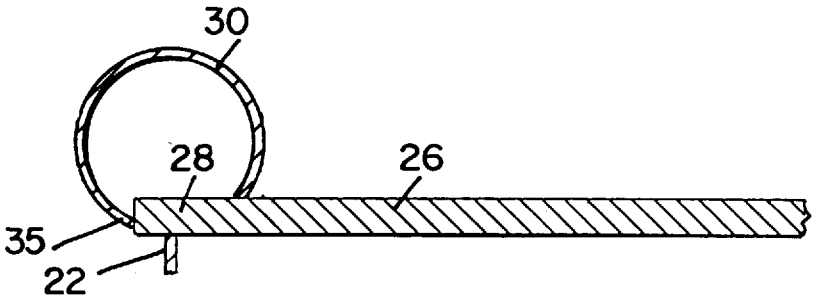
FIG. 6 is a horizontal cross-sectional view of the structure for bearing weight of FIG. 5, taken along the line 6—6, thereof, and looking in the direction of the arrows.
Figure 7:
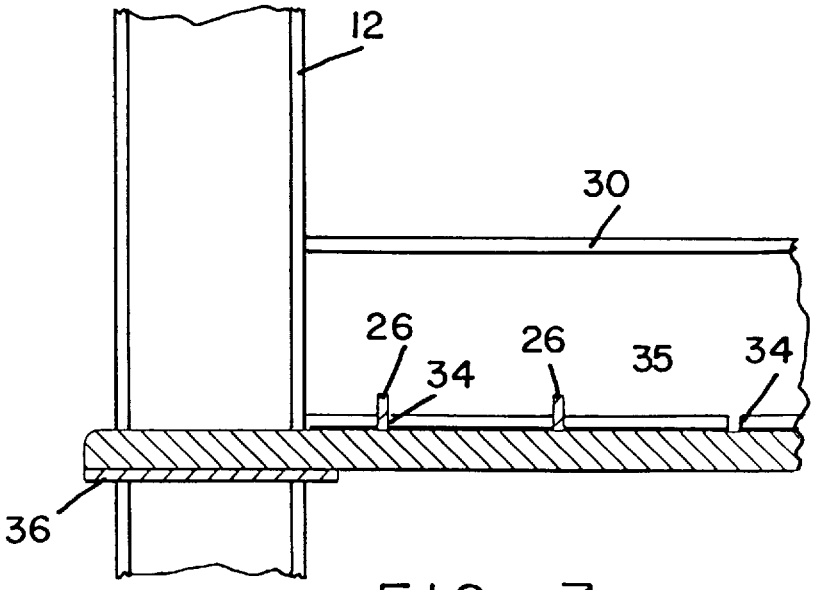
FIG. 7 is a horizontal cross-sectional view of the structure for bearing weight of FIG. 5, taken along the line 7—7, thereof, and looking in the direction of the arrows.

With reference now to the drawings, there is shown in FIGS. 5–7, a structure for bearing weight, embodying the principles of the present invention, and generally indicated by the reference numeral 10. The structure for bearing weight 10 is comprised of a vertical, hollow, elongated support post 12 having a sidewall 14. The support post 12 is generally tubular, with the sidewall 14 providing a pair of horizontally aligned apertures 16, each in the shape of an inverted-T. The aperture 16 therefore has an upright portion 18 and a crossbar portion 20.

A generally horizontal beam 22 intersects the sidewall 14 of the post 12 by passing through the upright portion 18 of each aperture 16. The beam 22 is shown as having an arcuate portion 24 at its end 25 for both aesthetic purposes and to help prevent injury due to its extension beyond the sidewall 14. At least one joist 26, having an end portion 28, is supported, at least in part, by the beam 22.

A generally horizontal, hollow, elongated support member 30, which is generally tubular, is positioned parallel to and adjacent the beam 22 and abuts the post 12. The beam 22 is external to the support member 30, and the support member 30 overlays at least a portion of the beam 22. The support member 30 has a sidewall 32 which provides an aperture 34 in its lower portion 35 to receive the end portion 28 of the joist 26. The aperture 34 in the sidewall 32 of the support member 30 is of sufficient depth to permit the joist 26 to be in contact with the beam 22 and thereby supported, at least in part, by the beam 22.

It can be seen that the use of the aperture 34 in the sidewall 32 of the support member 30 maintains the proper position of the joist 26, while also preventing the joist 26 from rotating about its central longitudinal axis.

Similarly, the use of the aperture 16 in the post 12 maintains the beam 22 in proper position and orientation.

Optionally, this embodiment can also include an elongated weight distribution member 36, positioned parallel to, beneath and in contact with the beam 22. The weight distribution member 36 intersects the sidewall 14 of the post 12 by passing through the two, horizontally aligned crossbar portions 20 of the apertures 16. In this position, the weight distribution member 36 supports at least a portion of the weight of the beam 22. The use of the weight distribution member 36 allows the load from the beam 22 to be distributed over more of the load bearing circumference of the post 12. The weight distribution member 36 is optional, since a beam 22 of sufficient width could accomplish the same weight distributing function, or the post 12 could be of a material sufficiently resistant to shear.

The post 12 and support member 30 can be formed of thick cardboard, such as might be used as a form for a concrete foundation footing. Cardboard with a thickness of ¼ inch has proven satisfactory, but another thickness may be employed with equal success. Alternatively, the post 12 and support member 30 may be formed of a synthetic resin, metal, or other suitable material. The post 12 and support member 30 may be decorated with paint or wall paper, or, if made of synthetic resin, created to be transparent. The beam 22, joist 26 and weight distribution member 36 may be formed of wood, metal or synthetic resin. A cross section of one inch by three inches for the beams and joists has proven satisfactory, but other dimensions can be employed with satisfactory results.

In assembling the structure for bearing weight 10, the post 12 is erected vertically and the weight distribution member 36 inserted through the crossbar portion 20 of both apertures 16. The beam 22 is then inserted through the upright portion 18 of both apertures 16 and allowed to rest upon the weight distribution member 36. The end portion 28 of the joist 26 is then allowed to rest upon the beam 22 and the support member 30 positioned parallel and adjacent to the beam 22 so that the aperture 34 in the lower portion 35 of the sidewall 32 of the support member 30 receives the end portion 28 of the joist 26. The support member 30 is then secured to the post 12 by means of an adhesive (not shown), any suitable fastener (not shown), or a strap (not shown).

In a variation of this embodiment, the post 12 need not be vertical, but can be upwardly directed. Moreover, the beam 22 and the weight distribution member 36 could be constructed integrally.

Also, one could envision a variation of this embodiment wherein the beam 22 and the weight distribution member 36 intersect the sidewall 14 of the post 12 just once by passing through only one of the apertures 16.

Finally, the post 12 and the support member 30 need not be tubular, but could have a different cross-section.

Figure 12:
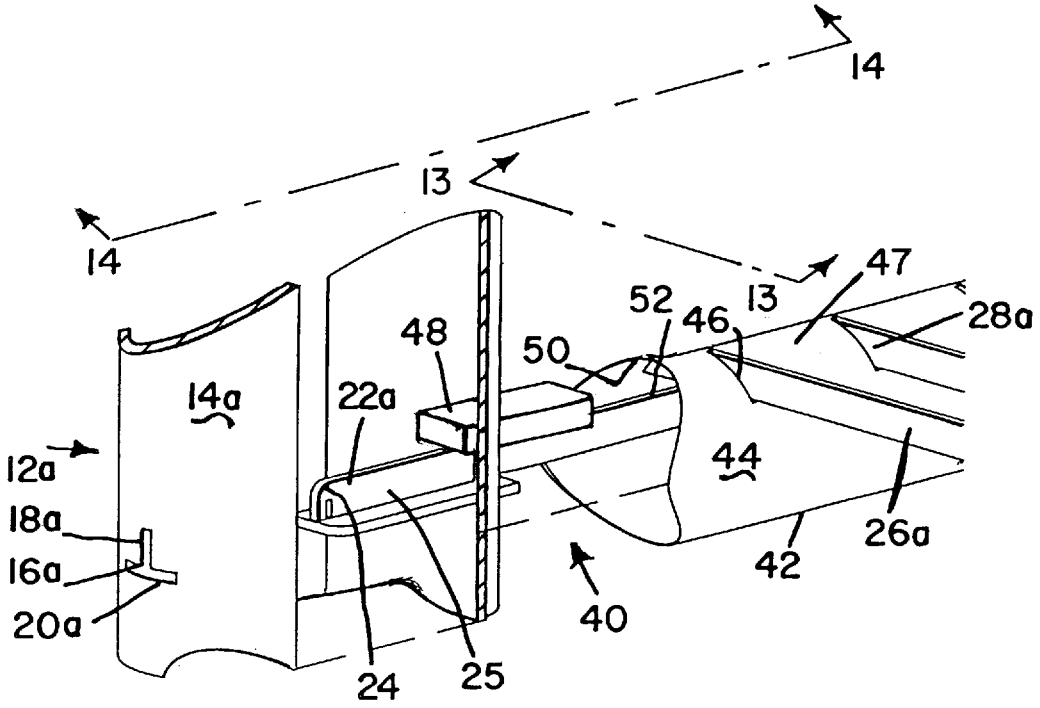
FIG. 12 is an exploded perspective view, in enlarged scale, of still another embodiment of a structure for bearing weight, embodying the principles of the present invention and showing the post sectioned and broken away to show detail, with the beam, joists, post and support members in fragment.
Figure 13:
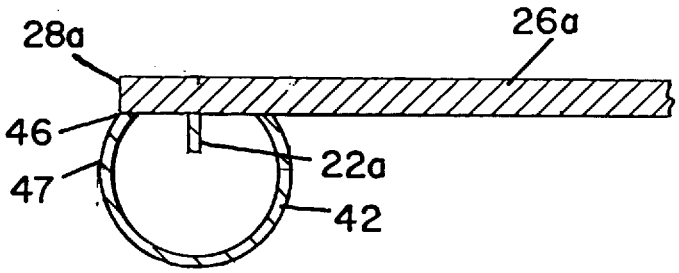
FIG. 13 is a horizontal cross-sectional view of the structure for bearing weight of FIG. 12, taken along the line 13—13, thereof, and looking in the direction of the arrows.
Figure 14:
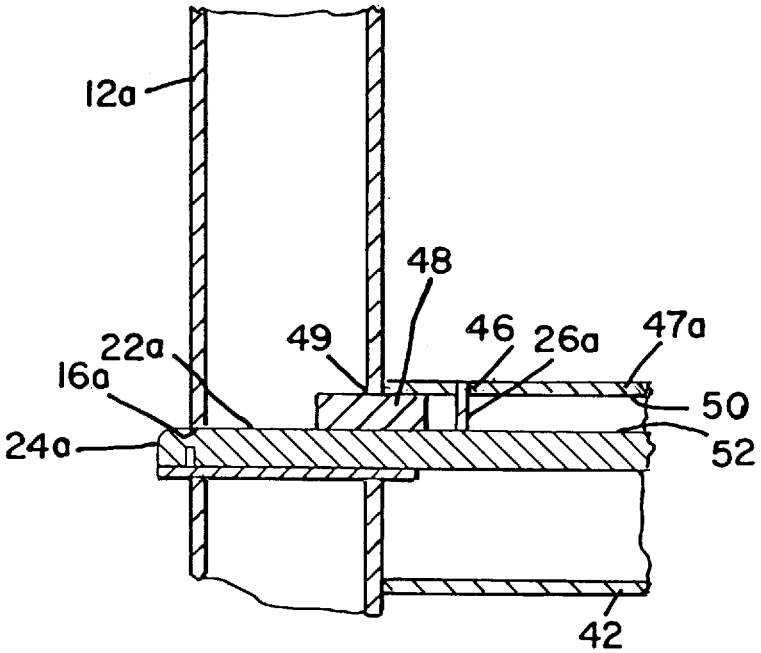
FIG. 14 is a horizontal cross-sectional view of the structure for bearing weight of FIG. 13, taken along the line 14—14, thereof, and looking in the direction of the arrows.

Turning to FIGS. 12–14, there is shown a second embodiment of a structure for bearing weight, embodying the principles of the present invention, and generally indicated by the reference numeral 40.

This second embodiment is identical to the previous embodiment except as noted below. Elements having reference numerals with a suffix are identical to elements with the same numeral, but no suffix, in the previous embodiment.

In this embodiment, similar to the previous embodiment, a generally horizontal, hollow, elongated support member 42, which is generally tubular, is positioned parallel to and adjacent the beam **22*a* and abuts the post 12*a*. However, in this embodiment, the support member 42 surrounds at least a portion of the beam 22*a***.

The support member 42 has a sidewall 44 which provides an aperture 46 in its upper portion 47 to receive the end portion 28*a* of the joist 26*a*.

As in the previous embodiment, the aperture 46 in the sidewall 44 of the support member 42 is of sufficient depth to permit the joist 26*a* to be in contact with the beam 22*a* and thereby supported, at least in part, by the beam 22*a*.

The acceptable materials, and dimensions for this embodiment are the same as for the previous embodiment.

In assembling the structure for bearing weight 40, the post 12*a* is erected vertically and the weight distribution member 36*a* positioned as in the previous embodiment. The beam 22*a* is first placed within the support member 42, and then inserted through the upright portion 18*a* of both apertures 16*a* and allowed to rest upon the weight distribution member 36*a*. The end portion 28*a* of the joist 26*a* is then placed in the aperture 46 and allowed to rest upon the beam 22*a*. The support member 42 is then secured to the post 12*a* as in the previous embodiment.

All of the variations set forth for the previous embodiment are applicable to this embodiment. Additionally, a spacer block 48 can be positioned to extend from the inner surface 50 of the sidewall 44 of the support member 42 to the upper surface 52 of the beam 22*a*. The spacer block 48 also intersects the sidewall 14*a* of the post 12*a* by passing through an aperture 49 in the sidewall 14*a*. A fastener (not shown) may be used to secure the spacer block 48 to the beam 22*a* to prevent slippage. The spacer block 48 can be used to limit the radial movement of the support member 42 relative to the beam 22*a*.

Turning next to FIGS. 1–4 and 8, there is shown a third embodiment of a structure for bearing weight, embodying the principles of the present invention, and generally indicated by the reference numeral 55. This structure for bearing weight 55 is in the form of a bunk bed, and is comprised of four vertical, horizontally spaced, hollow, elongated support posts 56, 57, 58 and 59, each having an upper end 60, 61, 62 and 63, respectively, lower end 64, 65, 66 and 67, respectively, and sidewall 68, 69, 70 and 71, respectively.

A first generally horizontal beam 72 extends between a first pair of the posts 56, 57, adjacent their lower ends 64,65 and intersecting their sidewalls 68, 69. Specifically, one end 76 of the first beam 72 passes through the upright portion 80 of two horizontally aligned, inverted-T shaped apertures 78 in the sidewall 68 of the post 56 and the other end 76 of the first beam 72 passes through the upright portion 80 of two horizontally aligned, inverted-T shaped apertures 78 in the sidewall 69 of the post 57. The apertures 78 each also have a crossbar portion 82.

A second generally horizontal beam 84 extends between a second pair of the posts 58, 59, adjacent their lower ends 66, 67 and intersecting their sidewalls 70, 71. Analogous to the positioning of the first beam 72, one end 88 of the second beam 84 passes through the upright portion 80 of two horizontally aligned, inverted-T shaped apertures 78 in the sidewall 70 of the post 58 and the other end 88 of the second beam 84 passes through the upright portion 80 of the two horizontally aligned, inverted-T shaped apertures 78 in the sidewall 71 of the post 59.

The first beam 72 and the second beam 84 are positioned to be coplanar and horizontally spaced.

The structure for bearing weight is also comprised of at least two parallel, spaced, coplanar lower joists 90. The plane in which the lower joists 90 lie is generally parallel to the generally horizontal plane in which the first beam 72 and the second beam 84 lie. Each of the lower joists 90 is supported by both of the first beam 72 and the second beam 84. Further, each of the lower joists 90 is provided with an end portion 92 and an intermediate portion 94.

A first generally horizontal, hollow, elongated support member 96, which is generally tubular, is positioned parallel to and adjacent the first beam 72 and extends between and abuts the first pair of posts 56, 57. The first beam 72 is external to the first support member 96, and the first support member 96 overlays at least a portion of the beam 72. The first support member 96 has a sidewall 98 which provides a plurality of apertures 100 in its lower portion 101 to receive the end portion 92 of each of the lower joists 90. The lower joists 90 are supported, at least in part, by the first beam 72.

As in the previous embodiments, it can be seen that the use of the apertures 100 in the lower portion 101 of the sidewall 98 of the first support member 96 maintains the proper position of the lower joists 90, while also preventing each of the lower joists 90 from rotating about its central longitudinal axis.

Similarly, the use of the inverted-T shaped apertures 78 in each of the posts 56, 57, 58 and 59 maintains the first beam 72 and the second beam 84 in proper position and orientation.

A second generally horizontal hollow, elongated support member 102, which is generally tubular, is positioned parallel to and adjacent the second beam 84 and extends between and abuts the second pair of posts 58, 59. The second support member 102 surrounds at least a portion of the second beam 84. The second support member 102 has a sidewall 104 which provides a plurality of apertures 106 in its upper portion 107 to receive the end portion 92 of each of the lower joists 90. Each aperture 106 in the sidewall 104 of the second support member 102 is of sufficient depth to permit the lower joists 90 to be in contact with the second beam 84 and thereby supported, at least in part, by the second beam 84. The purpose of the apertures 106 is the same as for the apertures 100.

A first elongated weight distribution member 108 is positioned beneath each end 76 of the first beam 72, parallel and in contact with the first beam 72 to support at least a portion of the weight of the first beam 72. One of the first weight distribution members 108 intersects the sidewall 68 of the post 56 by passing through the two, horizontally aligned crossbar portions 82 of the apertures 78 in the sidewall 68 of the post 56. The other of the first weight distribution members 108 intersects the sidewall 69 of the post 57 by passing through the two, horizontally aligned crossbar portions 82 of the apertures 78 in the sidewall 69 of the post 57. In this position, each of the first weight distribution members 108 supports at least a portion of the weight of the first beam 72. As mentioned for the previous embodiments, the use of the first weight distribution members 108 allows the load from the beam 72 to be distributed over more of the load bearing circumference of each of the first pair of posts 56, 57.

Analogously, a second elongated weight distribution member 110 is positioned beneath each end 88 of the second beam 84, parallel and in contact with the second beam 84 to support at least a portion of the weight of the second beam 84. One of the second weight distribution members 110 intersects the sidewall 70 of the post 58 by passing through the two, horizontally aligned crossbar portions 82 of the apertures 78 in the sidewall 70 of the post 58. The other of the second weight distribution members 110 intersects the sidewall 71 of the post 59 by passing through the two, horizontally aligned crossbar portions 82 of the apertures 78 in the sidewall 71 of the post 59. In this position, each of the second weight distribution members 110 supports at least a portion of the weight of the second beam 84. The second weight distribution members 110 serve the same purpose as the first weight distribution members 108.

A first strap 112, or first retaining means, circumscribes the first support member 96 and the first pair of posts 56, 57 to retain the first support member 96 in rigid contact with the first pair of posts 56, 57. Similarly, a second strap 114, or second retaining means, circumscribes the second support member 102 and the second pair of posts 58, 59 to retain the second support member 102 in rigid contact with the second pair of posts 58, 59. To prevent displacement, the second strap 114 passes through a strap notch 115 on each of the ends 88 of the second beam 84. Each of the first strap 112 and the second strap 114 are provided with a buckle (not shown) to allow for tension adjustment.

The lower joists 90 are dimensioned and configured to operatively support a lower bed mattress 116, which will typically be of full size. A relatively rigid panel (not shown) can be place upon the lower joists 90 to prevent damage to the lower bed mattress 116.

A third generally horizontal beam 118 extends between a pair of the posts 56, 58, adjacent their upper ends 60, 62, respectively, and intersects their sidewalls 68, 70, respectively. Specifically, each end 122 of the third beam 118 passes through the upright portion 80 of two horizontally aligned, inverted-T shaped apertures 78 in each of the sidewall 68 of the post 56 and the sidewall 70 of the post 58.

A fourth generally horizontal beam 124 extends between a pair of the posts 57, 59, adjacent their upper ends 61, 63, respectively, and intersects their sidewalls 69, 71, respectively. Analogous to the positioning of the third beam 118, each end 128 of the fourth beam 124 passes through the upright portion 80 of two horizontally aligned, inverted-T shaped apertures 78 in each of the sidewall 69 of the post 57 and the sidewall 71 of the post 59.

The third beam 118 and the fourth beam 124 are positioned to be coplanar and horizontally spaced.

The structure for bearing weight is also comprised of at least two parallel, spaced, coplanar upper joists 130. The plane in which the upper joists 130 lie is generally parallel to the generally horizontal plane in which the third beam 118 and the fourth beam 124 lie. Each of the upper joists 130 is supported by both of the third beam 118 and the fourth beam 124. Further, each of the upper joists 130 is provided with a pair of end portions 132.

A third generally horizontal, hollow, elongated support member 134, which is generally tubular, is positioned parallel to and adjacent the third beam 118 and extends between and abuts the pair of posts 56, 58 between which the third beam 118 extends. The third support member 134 surrounds at least a portion of the third beam 118. The third support member 134 has a sidewall 136 which provides a plurality of apertures 138 in its upper portion 139 to receive an end portion 132 of each of the upper joists 130. Each aperture 138 in the sidewall 136 of the third support member 134 is of sufficient depth to permit the upper joists 130 to be in contact with the third beam 118 and thereby supported, at least in part, by the third beam 118.

As in the previous embodiments, it can be seen that the use of the apertures 138 in the upper portion 139 of the sidewall 136 of the third support member 134 maintains the proper position and orientation of the upper joists 130. Similarly, the use of the apertures 78 in each of the sidewalls 68, 70 of the pair of posts 56, 58, respectively, maintains the third beam 118 in the proper position and orientation.

A fourth generally horizontal, hollow, elongated support member 140, which is generally tubular, is positioned parallel to and adjacent the fourth beam 124 and extends between and abuts the pair of posts 57, 59 between which the fourth beam 124 extends. The fourth support member 140 surrounds at least a portion of the fourth beam 124. The fourth support member 140 has a sidewall 142 which provides a plurality of apertures 144 in its upper portion 145 to receive an end portion 132 of each of the upper joists 130. Each aperture 144 in the sidewall 142 of the fourth support member 140 is of sufficient depth to permit the upper joists 130 to be in contact with the fourth beam 124 and thereby supported, at least in part, by the fourth beam 124.

The apertures 144 in the upper portion 145 of the sidewall 142 of the fourth support member 140 serve the same purpose as the apertures 138 in the upper portion 139 of the sidewall 136 of the third support member 134. Similarly, the use of the apertures 78 in each of the sidewalls 69, 71 of the pair of posts 57, 59, respectively, maintains the fourth beam 124 in proper position and orientation.

A third elongated weight distribution member 146 is positioned beneath each end 122 of the third beam 118, parallel and in contact with the third beam 118 to support at least a portion of the weight of the third beam 118. One of the third weight distribution members 146 intersects the sidewall 68 of the post 56 by passing through the two, horizontally aligned crossbar portions 82 of the apertures 78 in the sidewall 68 of the post 56. The other of the third weight distribution members 146 intersects the sidewall 70 of the post 58 by passing through the two, horizontally aligned crossbar portions 82 of the apertures 78 in the sidewall 70 of the post 58. In this position, each of the third weight distribution members 146 supports at least a portion of the weight of the third beam 118.

Analogously, a fourth elongated weight distribution member 148 is positioned beneath each end 128 of the fourth beam 124, parallel and in contact with the fourth beam 124 to support at least a portion of the weight of the fourth beam 124. One of the fourth weight distribution members 148 intersects the sidewall 69 of the post 57 by passing through the two, horizontally aligned crossbar portions 82 of the apertures 78 in the sidewall 69 of the post 57. The other of the fourth weight distribution members 148 intersects the sidewall 71 of the post 59 by passing through the two, horizontally aligned crossbar portions 82 of the apertures 78 in the sidewall 71 of the post 59. In this position, each of the fourth weight distribution members 148 supports at least a portion of the weight of the fourth beam 124.

A pair of first spacer blocks (not shown), but identical to the spacer block 48 extends from the inner surface (not shown) of the sidewall 136 of the third support member 134 to the upper surface (not shown) of the third beam 118. One of the first spacer blocks intersects the sidewall 68 of the post 56. The other of the first spacer blocks intersects the sidewall 70 of the post 58. The first spacer blocks serve to limit the radial movement of third support member 134 relative to the third beam 118. To prevent slippage, one of the first spacer blocks can be sized to extend between the joist 130 adjacent to it and the portion of the sidewall 68 of the post 56 opposing the portion of the sidewall 68 intersected by the first spacer block. The other of the first spacer blocks can be sized to extend between the joist 130 adjacent to it and the portion of the sidewall 70 of the post 58, opposing the portion of the sidewall 70 intersected by the first spacer block.

A pair of second spacer blocks (not shown), but also identical to the spacer block 48 extends from the inner surface (not shown) of the sidewall 142 of the fourth support member 140 to the upper surface (not shown) of the fourth beam 124. One of the second spacer blocks intersects the sidewall 69 of the post 57. The other of the second spacer blocks intersects the sidewall 71 of the post 59. The second spacer blocks serve to limit the radial movement of fourth support member 140 relative to the fourth beam 124. To prevent slippage, one of the second spacer blocks can be sized to extend between the joist 130 adjacent to it and the portion of the sidewall 69 of the post 57 opposing the portion of the sidewall 69 intersected by the second spacer block. The other of the second spacer blocks can be sized to extend between the joist 130 adjacent to it and the portion of the sidewall 71 of the post 59, opposing the portion of the sidewall 71 intersected by the second spacer block.

A third strap 149, or third retaining means, circumscribes the third support member 134 and the pair of posts 56, 58 between which the third support member 134 extends to retain the third support member 134 in rigid contact with the pair of posts 56, 58 between which it extends. The third strap 149 passes through a third strap notch 150 positioned at each of the ends 122 of the third beam 118 to maintain the third strap 149 in position. Similarly, a fourth strap 151, or fourth retaining means, circumscribes the fourth support member 140 and the pair of posts 57, 59 between which the fourth support member 140 extends to retain the fourth support member 140 in rigid contact with the pair of posts 57, 59 between which it extends. The fourth strap 151 passes through a fourth strap notch 152 positioned at each of the ends 128 of the fourth beam 124 to maintain the fourth strap 151 in position. Each of the third strap 149 and the fourth strap 151 are provided with a buckle (not shown) to allow for tension adjustment.

The upper joists 130 are dimensioned and configured to operatively support an upper bed mattress 154, which will typically be of twin size. A relatively rigid panel (not shown) can be place upon the upper joists 130 to prevent damage to the upper bed mattress 154.

Figure 8:
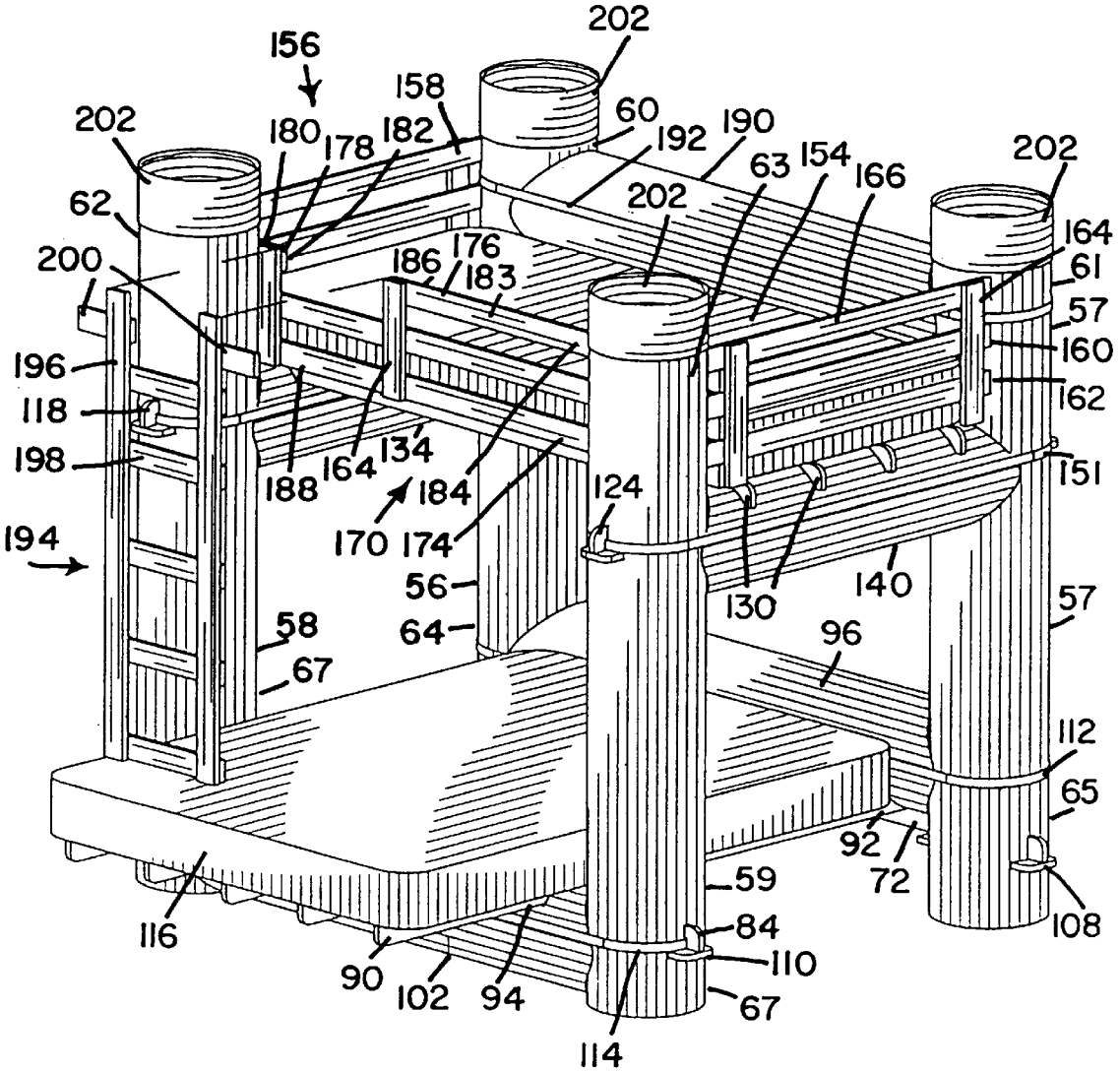
FIG. 8 is a perspective view of the structure for bearing weight of FIG. 1, with the ladder exploded from the remainder of the structure.

Turning especially to FIG. 8, it may be seen that the structure for bearing weight 60 is provided with a pair of side guard rail assemblies, generally indicated by the numeral 156. One side guard rail assembly 156 extends between the pair of posts 56, 58 between which the third support member 134 extends, adjacent the upper ends 60, 62, respectively, of the posts 56, 58, and the other side guard rail assembly 156 extends between the pair of posts 57, 59 between which the fourth support member 140 extends, adjacent the upper ends 61, 63, respectively, of the posts 57, 59. Both side guard rail assemblies 156 lie above the plane of the upper joists 130.

Each side guard rail assembly 156 is comprised of a plurality of horizontal spaced side horizontal slats 158, lying in a vertical plane. Each of the side horizontal slats 158 has a pair of ends 160. The ends 160 of the side horizontal slats 158 are received by apertures 162 in each of the pair of posts 56, 58 and the pair of posts 57, 59. A plurality of vertical spaced, vertical slats 164 are fastened to the outer faces 166 of the side horizontal slats 158 to provide further support.

A front guard rail assembly, generally indicated by the numeral 170 extends between the second pair of posts 58, 59 and is horizontally aligned with the two side guard rail assemblies 156. The front guard rail assembly 170 has at least one lower horizontal slat 172 with ends 174 closely fitting within the space between posts 58, 59 and the respective adjacent vertical slat 164 on the adjacent side guard rail assembly. Above the lower horizontal slat 172 is an upper horizontal slat 176 having a first portion 178, with a first end 180 closely fitting within the space between the post 58 and the adjacent vertical slat 164 on the adjacent guard rail assembly, and a second end 182. The upper horizontal slat 176 also has a second portion 183, with a first end 184 closely fitting within the space between the post 59 and the adjacent vertical slat 164 on the adjacent guard rail assembly, and a second end 186. A vertical slat 164 is positioned over the second end 182 of the first portion 178 of the upper horizontal slat 176 and the outer surfaces 188 of the lower horizontal slats 172. Another vertical slat 164 is positioned over the second end 186 of the second portion 183 of the upper horizontal slat 176 and the outer surfaces 188 of the lower horizontal slats 172.

A horizontal guard tube 190 extends between the first pair of posts 56, 57, and is horizontally aligned with the front guard rail assembly 170 and the side guard rail assemblies 156. A guard tube strap 192 circumscribes the guard tube 190 and the first pair of posts 56, 57 to retain the guard tube 190 in rigid contact with the first pair of posts 56, 57. The guard tube strap 192 is provided with a buckle (not shown) to allow for tension adjustment.

It should be noted that the fact that the first pair of posts 56, 57 and the second pair of posts 58, 59 extend above the upper bed mattress 154, they provide additional protection for a person resting on the upper bed mattress 154.

A ladder, generally indicated by the numeral 194 is comprised of stiles 196 and rungs 198 configured in the usual manner and mounted to the front guard rail assembly 170 with the stiles 196 positioned inside of the vertical slats 164 of the front guard rail assembly 170. An ear 200 is attached to each of the stiles 196 of the ladder 194 and extends outwardly at right angles to the stiles 196 and parallel to the front guard rail assembly 170. When the ladder is mounted to the front guard rail assembly 170, the ears 200 are positioned between the uppermost of the lower horizontal slats 172 and the upper horizontal slat 176, behind the vertical slats 164, to secure the ladder in position. The bottom of the ladder 194 rests on the lower bed mattress 116.

A bowl shaped insert 202 is placed inside of each of the posts 56, 57, 58 and 59, at its upper end 60, 61, 62 and 63, respectively, to hold toys of various types, or other items.

The posts 56, 57, 58 and 59, beams 72, 84, 118 and 124, lower joists 90, upper joists 130, and support members 96, 102, 134 and 140 are made of the same material as in the previous embodiments. Again, if cardboard tubes are employed for the posts 56, 57, 58 and 59 and the support members 96, 102, 134 and 140, a thickness of ¼ inches has proven satisfactory, but another thickness may be employed with equal success. Also, a cross-section of one inch by three inches has proven satisfactory for the beams 72, 84 118 and 124, lower joists 90 and upper joists 130, but other dimensions may work equally well. The straps 112, 114, 149, 151 and 192 are formed of a relatively non-elastic material such as canvas, leather or a relatively inelastic synthetic resin. The weight distribution members 108, 110, 146 and 148, the spacer blocks, the side guard rail assemblies 156, front guard rail assembly 170 and ladder 194 are generally formed of wood, synthetic resin, metal or other suitable material. The horizontal guard tube will generally be formed of the same material as the posts 56, 57, 58 and 59. The panels (not shown) covering the lower joists 90 and the upper joists 130 are typically formed of plywood, but other materials such as a lightweight metal or a strong synthetic resin may be used with equivalent results.

In assembling the structure for bearing weight 60, the four posts 56, 57, 58 and 59 are erected vertically. One of the first weight distribution members 108 is inserted through the crossbar portion 82 of both horizontally aligned apertures 78 in the lower end 64 of the post 56. The other of the first weight distribution members 108 is inserted through the crossbar portion 82 of both horizontally aligned apertures 78 in the lower end 65 of the post 57. One end 76 of the first beam 72 is then inserted through the upright portion 80 of both horizontally aligned apertures 78 in the lower end 64 of the post 56. The other end 76 of the first beam 72 is then inserted through the upright portion 80 of both horizontally aligned apertures 78 in the lower end 65 of the post 57. The first beam 72 is allowed to rest upon each of the first weight distribution members 108.

One of the second weight distribution members 110 is inserted through the crossbar portion 82 of both horizontally aligned apertures 78 in the lower end 66 of the post 58. The other of the second weight distribution members 110 is inserted through the crossbar portion 82 of both horizontally aligned apertures 78 in the lower end 67 of the post 59. The second beam 84 is first inserted through the second support member 102. Then, one end 88 of the second beam 84 is inserted through the upright portion 80 of both horizontally aligned apertures 78 in the lower end 66 of the post 58. The other end 88 of the second beam 84 is inserted through the upright portion 80 of both horizontally aligned apertures 78 in the lower end 67 of the post 59. The second beam 84 is allowed to rest upon each of the second weight distribution members 110. The second strap 114 is then pulled tight to securely fasten the second support member 102 to the posts 58, 59. Spacer blocks are not required for the second support member 102, since its proper radial spacing with the second beam 84 is maintained by resting the second support member 102 on the same surface (not shown) that the lower ends 64, 65, 66 and 67 of the posts 56, 57, 58 and 58, respectively, rests upon.

An end portion 92 of each of the lower joists 90 is placed on the first beam 72 and an intermediate portion 94 of each of the lower joists 90 is placed in one of the apertures 106 in the sidewall 104 of the second support member 102 and the lower joist 90 allowed to rest on the second beam 84. The first support member 96 is then extended between the first pair of posts 56, 57 and each end portion 92 placed on the first beam 72 positioned to be received in one of the apertures 100 in the lowermost portion 101 of the sidewall 98 of the first support member 96. The first strap 112 is then pulled tight to securely fasten the first support member 96 to the first pair of posts 56, 57.

One of the third weight distribution members 146 is inserted through the crossbar portion 82 of both horizontally aligned apertures 78 in the upper end 60 of the post 56. The other of the third weight distribution members 146 is inserted through the crossbar portion 82 of both horizontally aligned apertures 78 in the upper end 62 of the post 58. The third beam 118 is first inserted through the third support member 134. Then, one end 122 of the third beam 118 is inserted through the upright portion 80 of both horizontally aligned apertures 78 in the upper end 60 of the post 56. The other end 122 of the third beam 118 is inserted through the upright portion 80 of both horizontally aligned apertures 78 in the upper end 62 of the post 58. The third beam 118 is allowed to rest upon each of the third weight distribution members 146. A first spacer block (not shown) is positioned between the inner surface (not shown) of the sidewall 136 of the third support member 134 and the upper surface (not shown) of the third beam 118, at each of the ends 122 of the third beam 118. One of the first spacer blocks is inserted into an aperture (not shown) in the sidewall 68 of the post 56. The other of the first spacer blocks is inserted into an aperture (not shown) in the sidewall 70 of the post 58. The third strap 149 is then pulled tight to securely fasten the third support member 134 to the pair of posts 56, 58.

In a like manner, one of the fourth weight distribution members 148 is inserted through the crossbar portion 82 of both horizontally aligned apertures 78 in the upper end 61 of the post 57. The other of the fourth weight distribution members 148 is inserted through the crossbar portion 82 of both horizontally aligned apertures 78 in the upper end 63 of the post 59. The fourth beam 124 is first inserted through the fourth support member 140. Then, one end 128 of the fourth beam 124 is inserted through the upright portion 80 of both horizontally aligned apertures 78 in the upper end 61 of post 57. The other end 128 of the fourth beam 124 is inserted through the upright portion 80 of both horizontally aligned apertures 78 in the upper end 63 of post 59. The fourth beam 124 is allowed to rest upon each of the fourth weight distribution members 148. A second spacer block (not shown) is positioned between the inner surface (not shown) of the sidewall 142 of the fourth support member 140 and the upper surface (not shown) of the fourth beam 124, at each of the ends 128 of the fourth beam 124. One of the second spacer blocks is inserted into an aperture (not shown) in the sidewall 69 of the post 57. The other of the second spacer blocks is inserted into an aperture (not shown) in the sidewall 71 of the post 59. The fourth strap 151 is then pulled tight to securely fasten the fourth support member 140 to the posts 57, 59.

One end portion 132 of each of the upper joists 130 is placed in one of the apertures 138 in the upper portion 139 of the sidewall 136 of the third support member 134 and the upper joist 130 allowed to rest on the third beam 118. The other end portion 132 of each of the upper joists 130 is placed in one of the apertures 144 in the upper portion 145 of the sidewall 142 of the fourth support member 140 and the upper joist 130 also allowed to rest on the fourth beam 124.

Both side guard rail assemblies 156 can be pre-assembled by fastening the vertical slats 164 to the outer faces 166 of the side horizontal slats 158 by means of nails, screws, adhesive, or other suitable fastener. The side guard rail assemblies can be mounted to the structure for bearing weight 60 by inserting the ends 160 of the side horizontal slats 158 into the apertures 162 in the pair of posts 56, 58 and the pair of posts 57, 59. This insertion will typically need to occur prior to tightening the respective third strap 149 or fourth strap 151.

Similarly, the front guard rail assembly 170 can be pre assembled by mounting one vertical slat 164 over the second end 182 of the first portion 178 of the upper horizontal slat 176 and the outer surfaces 188 of the lower horizontal slats 172, and by mounting another vertical slat 164 over the second end 186 of the second portion 183 of the upper horizontal slat 176 and the outer surfaces 188 of the lower horizontal slats 172. The vertical slats 164 are fastened in the same manner as described above. The front guard rail assembly 170 can be mounted to the structure for bearing weight 60 by closely fitting the ends 174 of the lower horizontal slats 172 and the first end 180 of the first portion of the upper horizontal slat 176 and the first end 184 of the second portion 183 of the upper horizontal slat 176 within the space between the posts 58, 59 and the respective adjacent side guard rail assembly 156.

The guard tube 190 is placed between the first pair of posts 56, 57, horizontally aligned with the front guard rail assembly 170 and the side guard rail assemblies 156, and the guard tube strap 192 tightened to securely fasten the guard tube 190 to the first pair of posts 56, 57.

A panel (not shown) is then placed on top of the lower joists 90 and the lower bed mattress 116 placed on top of the panel. Another panel (not shown) is placed on top of the upper joists 130 and the upper bed mattress 154 placed on top of the panel.

The ladder 194 may also be pre assembled, with the stiles 196, rungs 198 and ears 200 fastened together in the same manner as described above. The ladder 194 is placed in position by lifting the lower end of the ladder 194 and allowing the ears 200 to be placed between the uppermost lower horizontal slat 172 and the upper horizontal slat 176, with the stiles 196 of the ladder 194 inside of the two vertical slats 164 of the front guard rail assembly 170. The ladder 194 is then secured by rotating it to the vertical position.

The bowls 202 are merely placed inside of the upper end 66 of the posts 56, 57, 58 and 59.

In a variation of this embodiment, the posts 56, 57, 58 and 59 need not be vertical, but can be upwardly directed. Optionally, the two first weight distribution members 108 could be constructed as one single weight distribution member extending the full length of the first beam 72. The same could be the for the other weight distribution members 110, 146 and 148. As with the previous embodiments, the weight distribution members 108, 110, 146 and 148 are optional, since beams 72, 84, 118 and 124 could each be of sufficient width to accomplish the same weight distributing function, or the posts 56, 57, 58 and 59 could be of a material sufficiently resistant to shear. Moreover, the first beam 72 and the first weight distribution members 108 could be integral as could the other beams 84, 118 and 124 and their respective weight distribution members 110, 146 and 148.

Another variation of this embodiment would be for each beam 72, 84, 118 and 124 and each weight distribution member 108, 110, 146 and 148 to intersect the applicable sidewalls 68, 69, 70 and 71 of each post 56, 57 58 and 59, respectively, only once, by passing through only one of the apertures 78.

In this embodiment, the first pair of posts 56, 57 and the second pair of posts 58, 59 are mutually exclusive. However, a variation would be for the two pairs of posts 56, 57 and 58, 59 to share a common post.

Additionally, the posts 56, 57, 58 and 59 and the support members 96, 102, 134 and 140, as well as the horizontal guard tube 190 need not be tubular, but could have a different cross-section.

Other variations in the basic geometry of the structure for bearing weight 60 are possible. For example, the upper joists 130 and lower joists 90 could be parallel to each other. However, it should be noted that if the upper joists 130 and lower joists 90 are perpendicular to each other, as shown in this embodiment, the projection of the third beam 118 and the fourth beam 124 onto the plane of the first beam 72 and the second beam 84 will be perpendicular to the first beam 72 and the second beam 84. At the point of intersection with the posts 56, 57, 58 and 59, this will lead to a distribution of the weight borne by the beams 72, 84, 118 and 124 over more of the circumference of the posts 56, 57, 58 and 59.

Moreover, the first beam 72 and second beam 84 need not be parallel to one another, nor must the plane that they lie in be horizontal. Similarly the third beam 118 and fourth beam 124 need not be parallel to one another, and their plane need not be horizontal.

Also, one could envision fasteners other than the straps 112, 114, 149 and 151, such as adhesive or conventional fasteners.

Finally, the bunk bed shown is merely one application of the structure for bearing weight. Other purposes can be readily envisioned, such as other styles of furniture, including tables.

Figure 9:
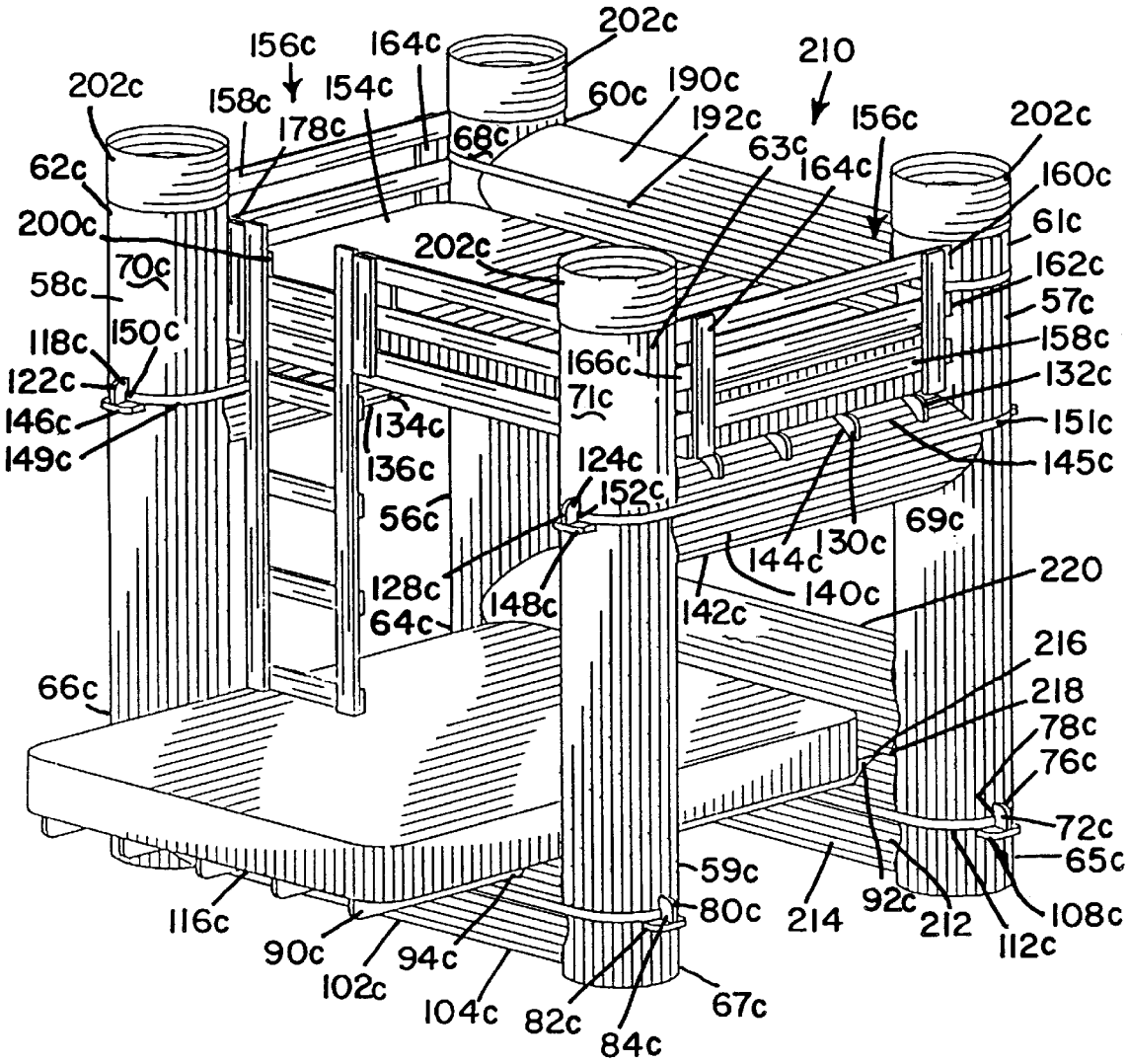
FIG. 9 is a perspective view of another embodiment of the structure for bearing weight, drawn to a slightly enlarged scale, and embodying the principles of the present invention.
Figure 10:
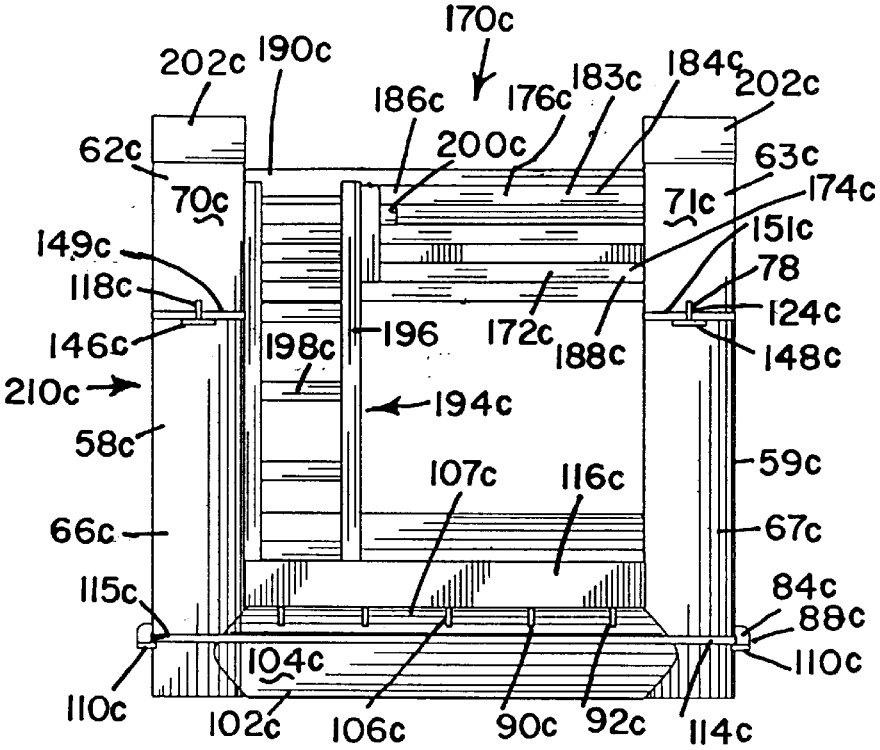
FIG. 10 is a front elevational view, drawn to a reduced scale, of the structure for bearing weight of FIG. 9.
Figure 11:
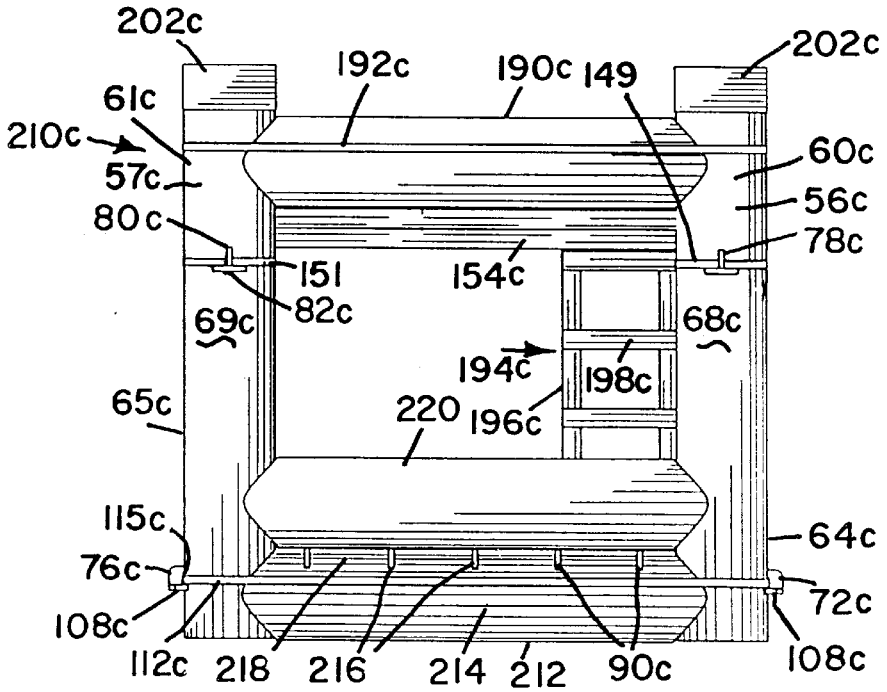
FIG. 11 is a rear elevational view, drawn to a reduced scale, of the structure for bearing weight of FIG. 9.

Turning next to FIGS. 9–11, there is shown a fourth embodiment of a structure for bearing weight, embodying the principles of the present invention, and generally indicated by the reference numeral 210. This structure for bearing weight 210 is also in the form of a bunk bed, and is identical to the previous embodiment except as noted below. Elements having reference numerals with a suffix are identical to elements with the same numeral, but no suffix, in the previous embodiment.

In this embodiment, similar to the previous embodiment, a generally horizontal, hollow, elongated first support member 212, which is generally tubular, is positioned parallel to and adjacent the first beam 72*c* and extends between and abuts the first pair of posts 56*c*, 57*c*. However, in this embodiment, the first support member 212 surrounds at least a portion of the first beam 72*c*.

The first support member 212 has a sidewall 214 which provides a plurality of apertures 216 in its upper portion 218 to receive the end portion 92*c* of each of the lowerjoists 90*c*. Each aperture 216 in the sidewall 214 of the first support member 212 is of sufficient depth to permit the lower joists 90*c* to be in contact with the first beam 72*c* and thereby supported, at least in part, by the first beam 72*c*.

Unlike the previous embodiment, this embodiment has a generally horizontal, hollow, elongated headboard member 220, which is generally tubular, extends between the first pair of posts 56*c*, 57*c*, and is positioned immediately above the first support member 212. The headboard member 220 serves primarily as a decorative headboard, but also adds somewhat to the overall support of the structure for bearing weight 210.

The materials of this embodiment, the dimensions and the available variations are identical to the previous embodiment. The assembly procedure varies slightly in that the first beam 72*c* is first inserted through the first support member 212. Then, one end 76*c* of the first beam 72*c* is inserted through the upright portion 80*c* of both horizontally aligned apertures 78*c* in the lower end 64*c* of the post 56*c*. The other end 76*c* of the first beam 72*c* is inserted through the upright portion 80*c* of both horizontally aligned apertures 78*c* in the lower end 65*c* of the post 57*c*. The first beam 72*c* is allowed to rest upon each of the first weight distribution members 108*c*. Before tightening the first strap 112*c*, the headboard member 220 is placed between the first pair of posts 56*c*, 57*c*. Tightening the first strap 112*c* then also securely fastens the headboard member 220 to the first pair of posts 56*c*, 57*c*. Spacer blocks are not required for the first support member 212, since its proper radial spacing with the first beam 72*c* is maintained by resting the first support member 212 on the same surface (not shown) that the lower ends 64*c*, 65*c* of the posts 56*c*, 57*c*, respectively, rests upon.

An end portion 92*c* of each of the lower joists 90*c* is placed in one of the apertures 216 in the sidewall 214 of the first support member 212 and the lower joist 90*c* allowed to rest on the first beam 72*c*.

Figure 15:
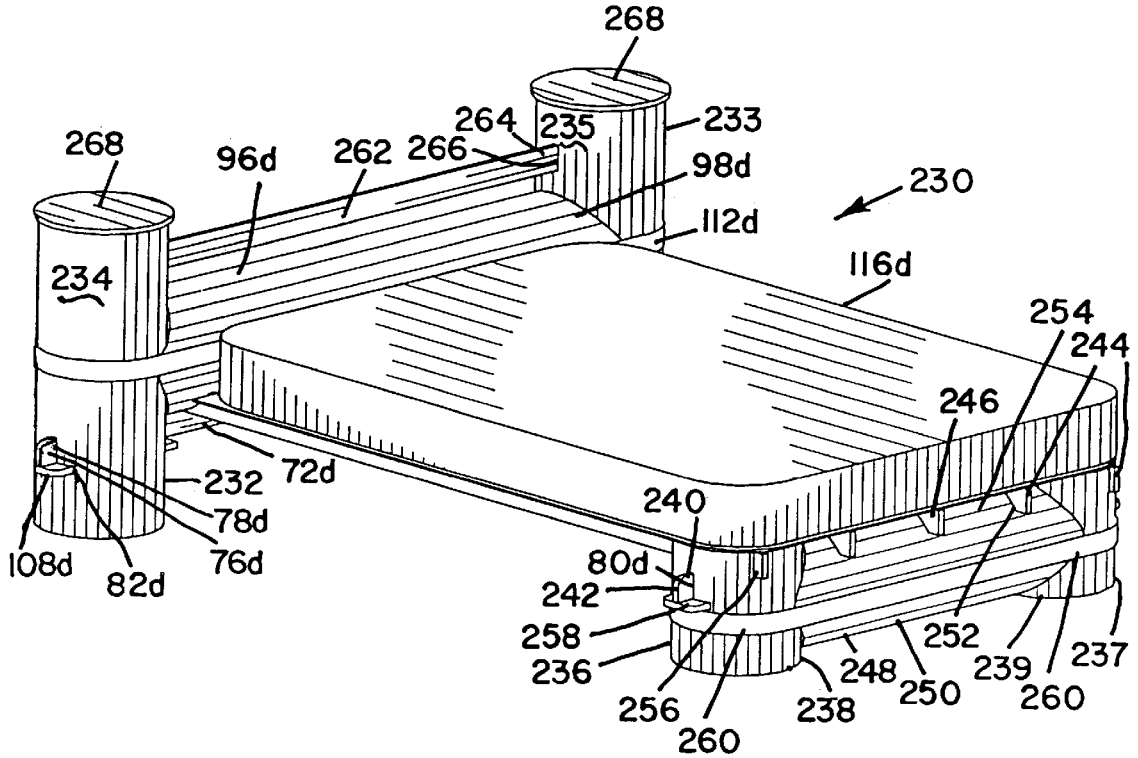
FIG. 15 is perspective view of a still further embodiment of a structure for bearing weight, embodying the principles of the present invention.
Figure 16:
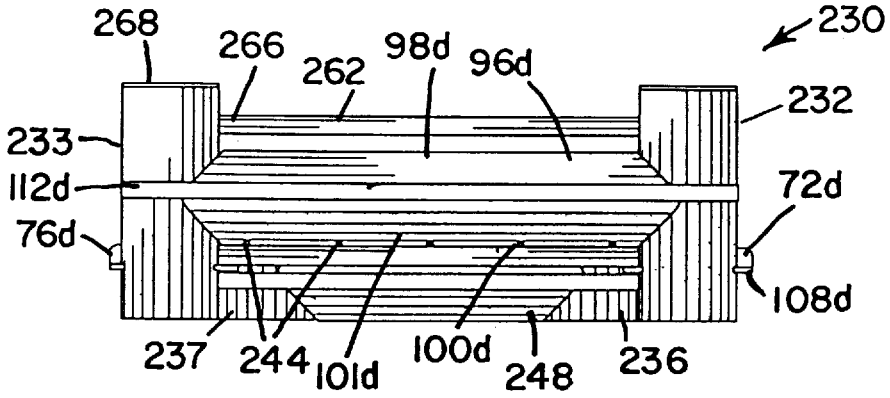
FIG. 16 is a rear elevational view, drawn to a reduced scale, of the structure for bearing weight of FIG. 15.
Figure 17:
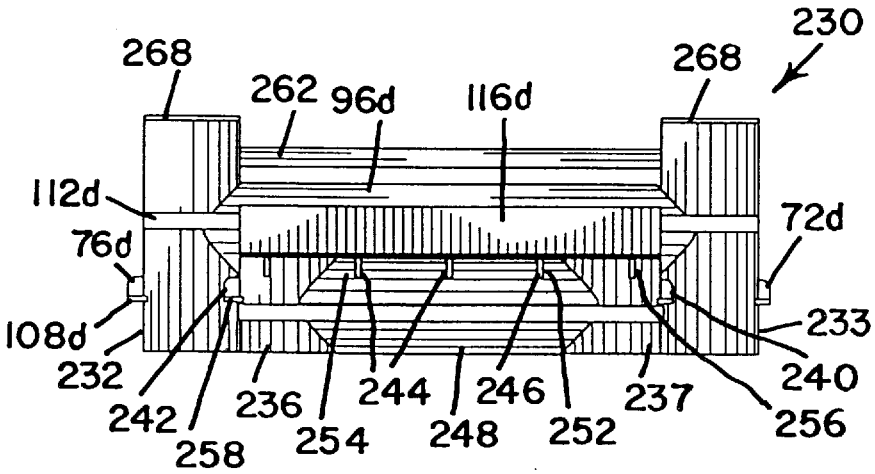
FIG. 17 is a front elevational view, drawn to a reduced scale, of the structure for bearing weight of FIG. 15.

Turning next to FIGS. 15–17, there is shown a fifth embodiment of a structure for bearing weight, embodying the principles of the present invention, and generally indicated by the reference numeral 230. In this embodiment, elements having reference numerals with a suffix are identical to elements with the same numeral, but no suffix, in the previous embodiment.

The structure for bearing weight 230 is in the form of a full bed, and is comprised of a first pair of vertical, horizontally spaced, hollow, elongated support posts 232, 233. The post 232 has a sidewall 234, and the post 233 has a sidewall 235. The structure for bearing weight 230 is further comprised of a second pair of vertical, horizontally spaced, hollow, elongated support posts 236, 237. The post 236 has a sidewall 238, and the post 237 has a sidewall 239. The second pair of posts 236, 237 are shorter in length than the first pair of support posts 232, 233.

A first generally horizontal beam 72*d* extends between the first pair of the posts 232, 233 and intersects their sidewalls 234, 235. Specifically, one end 76*d* of the first beam 72*d* passes through the upright portion 80*d* of two horizontally aligned, inverted-T shaped apertures 78*d* in the sidewall 234 of the post 232. The other end 76*d* of the first beam 72*d* passes through the upright portion 80*d* of two horizontally aligned, inverted-T shaped apertures 78*d* in the sidewall 235 of the post 233. Each of the apertures 78*d* also has a crossbar portion 82*d*.

A second generally horizontal beam 240, having a pair of ends 242, extends between the second pair of the posts 236, 237 and intersects their sidewalls 238, 239. Analogous to the positioning of the first beam 72*d*, one end 242 of the second beam 240 passes through the upright portion 80*d* of two horizontally aligned, inverted-T shaped apertures 78*d* in the sidewall 238 of the post 236. The other end 242 of the second beam 240 passes through the upright portion 80*d* of two horizontally aligned, inverted-T shaped apertures 78*d* in the sidewall 239 of the post 237.

The first beam 72*d* and the second beam 240 are positioned to be coplanar and horizontally spaced.

The structure for bearing weight is also comprised of at least two parallel, spaced, coplanar joists 244, each having a pair of end portions 246. The plane in which the joists 244 lie is generally parallel to the generally horizontal plane in which the first beam 72*d* and the second beam 240 lie. Each of the joists 244 is supported by both of the first beam 72*d* and the second beam 240.

A first generally horizontal, hollow, elongated support member 96*d*, which is generally tubular, is positioned parallel to and adjacent the first beam 72*d* and extends between and abuts the first pair of posts 232, 233. The first beam 72*d* is external to the first support member 96*d*, and the first support member 96*d* overlays at least a portion of the beam 72*d*. The first support member 96*d* has a sidewall 98*d* which provides a plurality of apertures 100*d* in its lower portion 101*d* to receive the end portion 92*d* of each of the lower joists 90*d*. The lower joists 90*d* are supported, at least in part, by the first beam 72*d*. The purpose of the apertures 100*d* is the same as for the apertures 100 in the third embodiment.

A second generally horizontal, hollow, elongated support member 248, which is generally tubular, is positioned parallel to and adjacent the second beam 240 and extends between and abuts the second pair of posts 236, 237. The second support member 248 surrounds at least a portion of the second beam 240. The second support member 248 has a sidewall 250 which provides a plurality of apertures 252 in its upper portion 254 to receive the end portion 92*d* of at least one of the lower joists 90*d*. Each aperture 252 in the sidewall 250 of the second support member 248 is of sufficient depth to permit the lower joists 90*d* to be in contact with the second beam 240 and thereby supported, at least in part, by the second beam 240. The purpose of the apertures 252 is the same as for the apertures 100*d*. Each of the second pair of posts 236, 237 is provided with a pair of horizontally aligned apertures 256 that is shaped similarly to the upright portion 80*d* of the aperture 78*d*. The pair of apertures 256 of the post 236 receives the end portion 92*d* of one of the lower joists 90*d*. Similarly, the pair of apertures 256 of the post 237 receives the end portion 92*d* of another of the lower joists 90*d*.

A first elongated weight distribution member 108*d* is positioned beneath each end 76*d* of the first beam 72*d*, parallel and in contact with the first beam 72*d* to support at least a portion of the weight of the first beam 72*d*. One of the first weight distribution members 108*d* intersects the sidewall 234 of the post 232, by passing through the two, horizontally aligned crossbar portions 82*d* of the apertures 78*d* in the sidewall 234 of the post 232. The other of the first weight distribution members 108*d* intersects the sidewall 235 of the post 233, by passing through the two, horizontally aligned crossbar portions 82*d* of the apertures 78*d* in the sidewall 235 of the post 233. In this position, each of the first weight distribution members 108*d* supports at least a portion of the weight of the first beam 72*d*.

Analogously, a second elongated weight distribution member 258 is positioned beneath each end 242 of the second beam 240, parallel and in contact with the second beam 240 to support at least a portion of the weight of the second beam 240. One of the second weight distribution members 258 intersects the sidewall 238 of the post 236 by passing through the two, horizontally aligned crossbar portions 82*d* of the apertures 78*d* in the sidewall 238 of the post 236. The other of the second weight distribution members 258 intersects the sidewall 239 of the post 237 by passing through the two, horizontally aligned crossbar portions 82*d* of the apertures 78*d* in the sidewall 239 of the post 237. In this position, each of the second weight distribution members 258 supports at least a portion of the weight of the second beam 240. The second weight distribution members 258 serve the same purpose as the first weight distribution members 108*d*.

A first strap 112*d*, or first retaining means, circumscribes the first support member 96*d* and the first pair of posts 232, 233 to retain the first support member 96*d* in rigid contact with the first pair of posts 232, 233. Similarly, a second strap 260, or second retaining means, circumscribes the second support member 248 and the second pair of posts 236, 237 to retain the second support member 248 in rigid contact with the second pair of posts 236, 237. Each of the first strap 112*d* and the second strap 260 are provided with a buckle (not shown) to allow for tension adjustment.

The joists 90*d* are dimensioned and configured to operatively support a bed mattress 116*d*, which will typically be of full size. A relatively rigid panel (not shown) can be place upon the joists 90*d* to prevent damage to the bed mattress 116*d*.

A horizontal slat 262, having end portions 264, is positioned between the first pair of posts 232, 233 and parallel to and above the first support member 96*d*, and is primarily for aesthetic purposes. The end portions 264 of the horizontal slat 262 are received by apertures 266 in the sidewalls 234, 235 of the first pair of posts 232, 233. Each of the first pair of posts 232, 233 is provided with a decorative cover 268.

The structure for bearing weight 230 of this embodiment is formed of the same materials as the previous embodiment, and the dimensions mentioned are equally applicable.

The assembly of the structure for bearing weight 230 is essentially the same as the assembly of the lower portion of the structure for bearing weight 60, with the only exception being that some of the ends 92*d* of the joists 90*d* are received by the apertures 256.

In a variation of this embodiment, the posts 232, 233, 236, and 237 need not be vertical, but can be upwardly directed. Optionally, the two first weight distribution members 108*d* could be constructed as one single weight distribution member extending the full length of the first beam 72*d*. The same could be the for the second weight distribution members 110*d*. For the reasons stated above, the use of the weight distribution members 108*d*, 110*d* is also optional. Moreover, the first beam 72*d* and the first weight distribution members 108*d* could be integral as could the second beam 240 and the second weight distribution members 110*d*.

Another variation of this embodiment would be for each beam 72*d*, 240 and each weight distribution member 108*d*, 110*d* to intersect each of the sidewalls 234, 235, 238 and 239 only once, by passing through only one of the apertures 78*d*.

In this embodiment, the first pair of posts 232, 233 and the second pair of posts 236, 237 are mutually exclusive. However, a variation would be for the first pair of posts 232, 233 and the second pair of posts 236, 237 to share a common post.

Additionally, the posts 232, 233, 236 and 237 and the support members 96*d*, 248 need not be tubular, but could have a different cross-section.

Other variations in the basic geometry of the structure for bearing weight 230 are possible. For example, the first beam 72*d* and second beam 240 need not be parallel to one another, nor must the plane that they lie in be horizontal.

Also, one could envision fasteners other than the straps 112*d*, 260, such as adhesive or conventional fasteners.

Finally, the full bed shown is merely one application of the structure for bearing weight. Other purposes can be readily envisioned, such as other styles of furniture, including tables.

Figure 18:
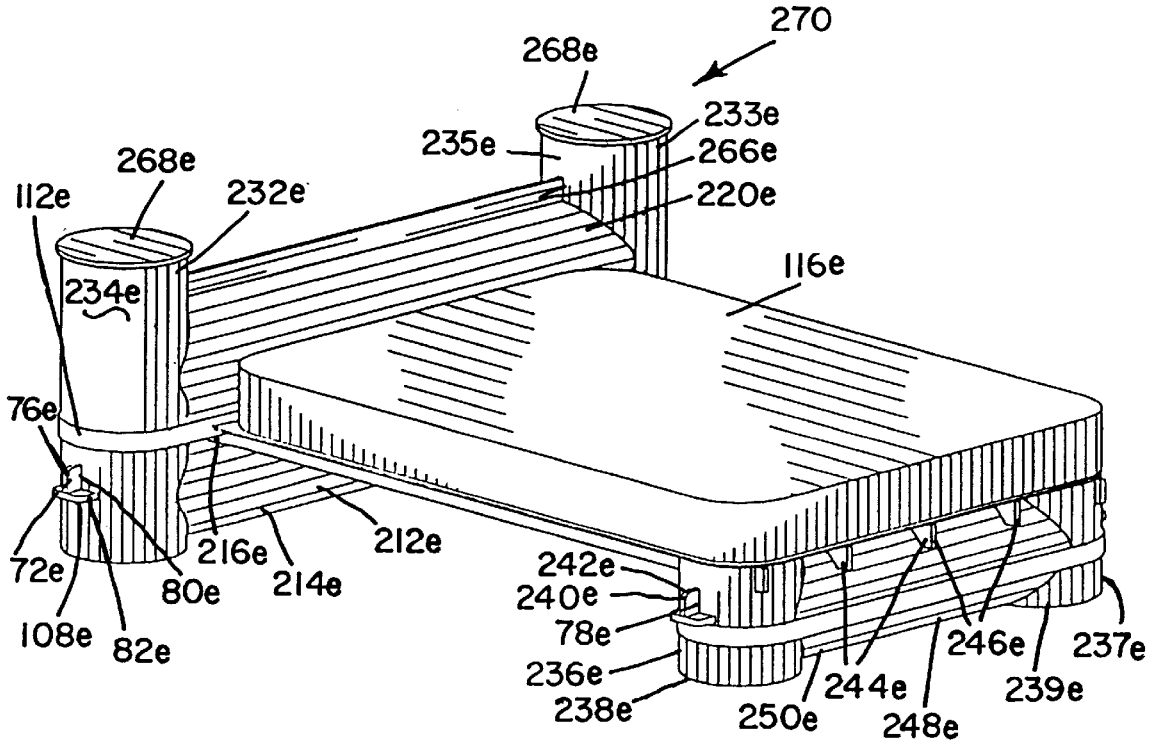
FIG. 18 is a perspective view of a still further embodiment of a structure for bearing weight, embodying the principles of the present invention.
Figure 19:
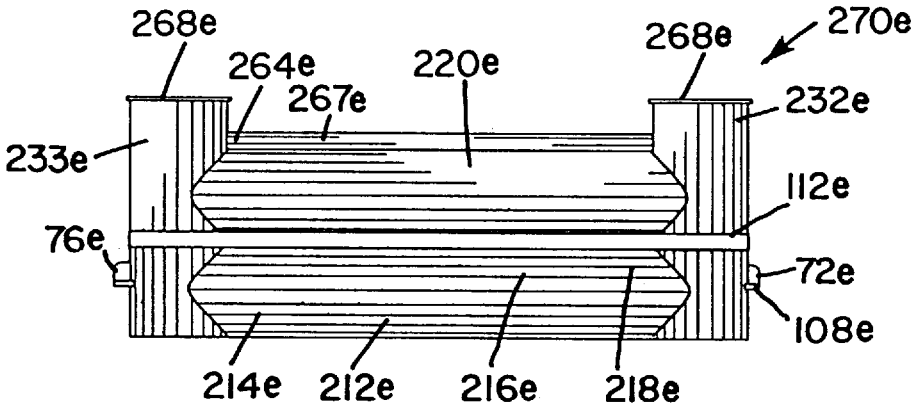
FIG. 19 is a rear elevational view, drawn to a reduced scale, of the structure for bearing weight of FIG. 18.
Figure 20:
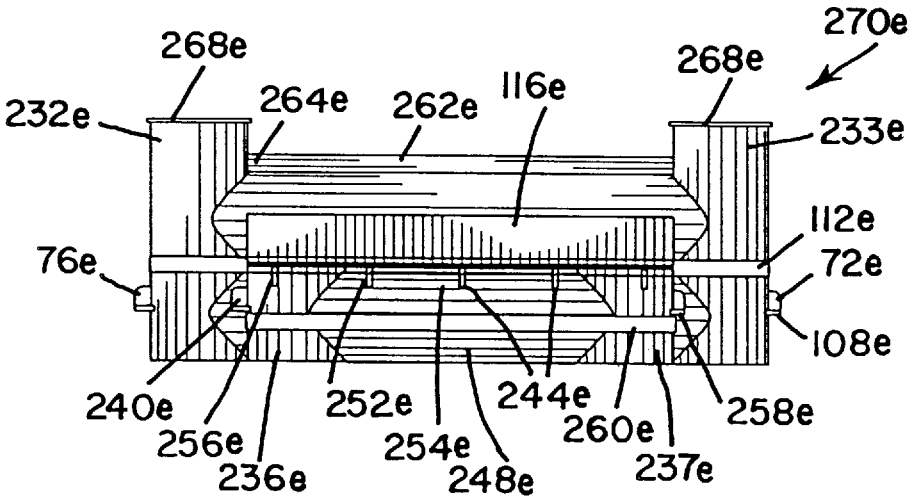
FIG. 20 is a front elevational view, drawn to a reduced scale, of the structure for bearing weight of FIG. 18.

Turning next to FIGS. 18–20, there is shown a sixth embodiment of a structure for bearing weight, embodying the principles of the present invention, and generally indicated by the reference numeral 270. This structure for bearing weight 270 is also of the form of a full bed, and is identical to the previous embodiment except as noted below. Elements having reference numerals with a suffix are identical to elements with the same numeral, but no suffix, in the previous embodiment.

In this embodiment, similar to the previous embodiment, a generally horizontal, hollow, elongated first support member 212*e*, which is generally tubular, is positioned parallel to and adjacent the first beam 72*e* and extends between and abuts the first pair of posts 232*e*, 233*e*. However, in this embodiment, the first support member 212*e* surrounds at least a portion of the first beam 72*e*.

The first support member 212*e* has a sidewall 214*e* which provides a plurality of apertures 216*e* in its upper portion 218*e* to receive the end portion 92*e* of each of the joists 90*e*. Each aperture 216*e* in the sidewall 214*e* of the first support member 212*e* is of sufficient depth to permit the joists 90*e* to be in contact with the first beam 72*e* and thereby supported, at least in part, by the first beam 72*e*.

Unlike the previous embodiment, this embodiment has a generally horizontal, hollow, elongated headboard member 220*e*, which is generally tubular, extends between the first pair of posts 232*e*, 233*e*, and is positioned immediately above the first support member 212*e*. The headboard member 220*e* serves primarily as a decorative headboard, but also adds somewhat to the overall support of the structure for bearing weight 270.

The materials of this embodiment, the dimensions mentioned above, and the available variations are identical to the previous embodiment. The assembly procedure varies slightly in that the first beam 72*e* is first inserted through the first support member 212*e*. Then, one end 76*e* of the first beam 72*e* is inserted through the upright portion 80*e* of both horizontally aligned apertures 78*e* in the sidewall 234*e* of the post 232*e*. The other end 76*e* of the first beam 72*e* is inserted through the upright portion 80*e* of both horizontally aligned apertures 78*e* in the sidewall 235*e* of the post 233*e*. The first beam 72*e* is allowed to rest upon each of the first weight distribution members 108*e*. Before tightening the first strap 112*e*, the headboard member 220*e* is placed between the first pair of posts 232*e*, 233*e*. Tightening the first strap 112*e* then also securely fastens the headboard member 220*e* to the first pair of posts 232*e*, 233*e*. Spacer blocks are not required for the first support member 212*e* since its proper radial spacing with the first beam 72*e* is maintained by resting the first support member 212*e* on the same surface (not shown) that the first pair of posts 232*e*, 233*e* rest upon.

An end portion 92*e* of each of the joists 90*e* is placed in one of the apertures 216*e* in the sidewall 214*e* of the first support member 212*e* and the joist 90*e* allowed to rest on the first beam 72*e*. The remainder of the assembly procedure is the same as for the previous embodiment.

It should be noted that the elements of each of the above embodiments may be provided in kit form for assembly by the user.

Thus, it can be seen from the foregoing detailed specification and attached drawings that the structure for bearing weight of the present invention provides for a more reliable joinder between its various components, while not offering dangerous protrusions. Moreover, the novel structure for bearing weight may be fabricated from readily available and easily formed components, without the use of tools, and through using few, if any fasteners. Finally, the structure for bearing weight is simple in construction, inexpensive to manufacture, and capable of a long life of useful service with a minimum of maintenance.

It is obvious that minor changes may be made in the form and construction of the invention without departing from the material spirit thereof. It is not, therefore, desired to confine the invention to the exact form herein shown and described, but it is desired to include all such as properly come within the scope claimed.

The invention having been thus described, what is claimed as new and desired to secure by Letters Patent is:

1. A structure for bearing weight, comprising:

(a) a plurality of upwardly directed, horizontally spaced, hollow, elongated support posts, each of said posts having a sidewall;

(b) a first generally horizontal beam extending between a first pair of said plurality of posts and intersecting the sidewalls thereof, said first beam having a pair of ends;

(c) a second generally horizontal beam extending between a second pair of said plurality of posts and intersecting the sidewalls thereof, said second beam having a pair of ends, said first beam and said second beam being coplanar and horizontally spaced;

(d) at least two parallel, spaced, coplanar joists, each of said joists being supported by both of said first beam and said second beam;

(e) a first generally horizontal, hollow, elongated support member positioned parallel to and adjacent said first beam and extending between and abutting said first pair of posts, said first support member having a sidewall, at least one of said sidewall of said first support member and said sidewalls of said first pair of posts providing a first group of at least two apertures, each aperture of said first group of apertures receiving a portion of one of said joists to allow said one of said joists to be supported at least in part by said first beam;

(f) a second generally horizontal, hollow, elongated support member positioned parallel to and adjacent said second beam and extending between and abutting said second pair of posts, said second support member having a sidewall, at least one of said sidewall of said second support member and said sidewalls of said second pair of posts providing a second group of at least two apertures, each aperture of said second group of apertures receiving a portion of one of said joists to allow said one of said joists a portion of which is received by said aperture of said second group of apertures to be supported at least in part by said second beam;

(g) first retaining means for retaining said first support member in rigid contact with said first pair of posts; and (h) second retaining means for retaining said second support member in rigid contact with said second pair of posts.

2. The structure for bearing weight of claim 1, wherein said first beam is external to said first support member and wherein said first support member overlays at least a portion of said first beam.

3. The structure for bearing weight of claim 2, wherein said plurality of posts, said first support member and said second support member are tubular.

4. The structure for bearing weight of claim 2, wherein said plurality of posts are generally vertical.

5. The structure for bearing weight of claim 2, wherein said first beam and said second beam are parallel to each other and lie in a generally horizontal plane, and wherein said at least two joists lie in a plane which is generally parallel to said generally horizontal plane in which said first beam and said second beam lie.

6. The structure for bearing weight of claim 2, wherein said first retaining means is a first strap which circumscribes said first support member and said first pair of posts, and wherein said second retaining means is a second strap which circumscribes said second support member and said second pair of posts.

7. The structure for bearing weight of claim 2, further comprising an elongated weight distribution member positioned beneath each end of said first beam, in contact therewith and parallel thereto to support at least a portion of the weight thereof, and an elongated weight distribution member positioned beneath each end of said second beam, in contact therewith and parallel thereto to support at least a portion of the weight thereof, each of said weight distribution members in contact with said first beam intersecting the sidewall of at least one of said first pair of posts, and each of said weight distribution members in contact with said second beam intersecting the sidewall of at least one of said second pair of posts.

8. The structure for bearing weight of claim 7, wherein said first beam and each of said weight distribution members in contact therewith are integral, and wherein said second beam and each of said weight distribution members in contact therewith are integral.

9. The structure for bearing weight of claim 2, wherein each of said sidewalls of said first pair of posts is intersected twice by said first beam, and wherein each of said sidewalls of said second pair of posts is intersected twice by said second beam.

10. The structure for bearing weight of claim 2, wherein said at least two joists are dimensioned and configured to operatively support a bed mattress.

11. The structure for bearing weight of claim 10, wherein:

(a) each of said plurality of posts has a lower end and an upper end;

(b) said first beam extends between said first pair of posts adjacent the lower ends thereof, and said second beam extends between said second pair of posts adjacent the lower ends thereof;

(c) said at least two parallel joists are lower parallel joists; and (d) each of said apertures receives a portion of one of said lower parallel joists;

said structure for bearing weight further comprising:

(a) a third generally horizontal beam extending between a pair of said plurality of posts, adjacent the upper ends thereof, and intersecting the sidewalls of said pair of posts between which said third beam extends;

(b) a fourth generally horizontal beam extending between a pair of said plurality of posts, adjacent the upper ends thereof, and intersecting the sidewalls of said pair of posts between which said fourth beam extends, said third beam and said fourth beam being coplanar and horizontally spaced;

(c) at least two parallel, spaced, coplanar upper joists, dimensioned and configured to operatively support a bed mattress, each of said upper joists being supported by both of said third beam and said fourth beam;

(d) a third generally horizontal, hollow, elongated support member positioned parallel to and adjacent said third beam and extending between and abutting said pair of posts between which said third beam extends, said third support member having a sidewall, at least one of said sidewall of said third support member and said sidewalls of said pair of posts between which said third support member extends providing a third group of at least two apertures, each aperture of said third group of apertures receiving a portion of one of said upper joists to allow said one of said upper joists to be supported at least in part by said third beam;

(e) a fourth generally horizontal, hollow, elongated support member positioned parallel to and adjacent said fourth beam and extending between and abutting said pair of posts between which said fourth beam extends, said fourth support member having a sidewall, at least one of said sidewall of said fourth support member and said sidewalls of said pair of posts between which said fourth support member extends providing a fourth group of at least two apertures, each aperture of said fourth group of apertures receiving a portion of one of said upper joists to allow said one of said upper joists a portion of which is received by said aperture of said fourth group of apertures to be supported at least in part by said fourth beam;

(f) third retaining means for retaining said third support member in rigid contact with said pair of posts between which said third support member extends; and (g) fourth retaining means for retaining said fourth support member in rigid contact with said pair of posts between which said fourth support member extends.

12. The structure for bearing weight of claim 11, wherein:

(a) said third support member surrounds at least a portion of said third beam member;

(b) said fourth support member surrounds at least a portion of said fourth beam member;

(c) said sidewall of said third support member and said sidewall of said fourth support member each have an inner surface; and (d) said third beam and said fourth beam each have an upper surface;

said structure for bearing weight further comprising:

(a) a first spacer block extending from said inner surface of said sidewall of said third support member to said upper surface of said third beam, said first spacer block intersecting at least one of the sidewalls of said pair of posts between which said third support member extends, said first spacer block being to limit the radial movement of said third support member relative to said third beam; and (b) a second spacer block extending from said inner surface of said sidewall of said fourth support member to said upper surface of said fourth beam, said second spacer block intersecting at least one of the sidewalls of said pair of posts between which said fourth support member extends, said second spacer block being to limit the radial movement of said fourth support member relative to said fourth beam.

13. The structure for bearing weight of claim 1, wherein said first support member surrounds at least a portion of said first beam.

14. The structure for bearing weight of claim 13, wherein said plurality of posts, said first support member and said second support member are tubular.

15. The structure for bearing weight of claim 13, wherein said plurality of posts are generally vertical.

16. The structure for bearing weight of claim 13, wherein said first beam and said second beam are parallel to each other and lie in a generally horizontal plane, and wherein said at least two joists lie in a plane which is generally parallel to said generally horizontal plane in which said first beam and said second beam lie.

17. The structure for bearing weight of claim 13, wherein said first retaining means is a first strap which circumscribes said first support member and said first pair of posts, and wherein said second retaining means is a second strap which circumscribes said second support member and said second pair of posts.

18. The structure for bearing weight of claim 13, further comprising an elongated weight distribution member positioned beneath each end of said first beam, in contact therewith and parallel thereto to support at least a portion of the weight thereof, and an elongated weight distribution member positioned beneath each end of said second beam, in contact therewith and parallel thereto to support at least a portion of the weight thereof, each of said weight distribution members in contact with said first beam intersecting the sidewall of at least one of said first pair of posts, and each of said weight distribution members in contact with said second beam intersecting the sidewall of at least one of said second pair of posts.

19. The structure for bearing weight of claim 18, wherein said first beam and each of said weight distribution members in contact therewith are integral, and wherein said second beam and each of said weight distribution members in contact therewith are integral.

20. The structure for bearing weight of claim 13, wherein each of said sidewalls of said first pair of posts is intersected twice by said first beam, and wherein each of said sidewalls of said second pair of posts is intersected twice by said second beam.

21. The structure for bearing weight of claim 13, wherein said at least two joists are dimensioned and configured to operatively support a bed mattress.

22. The structure for bearing weight of claim 21, wherein:

(a) each of said plurality of posts has a lower end and an upper end;

(b) said first beam extends between said first pair of posts adjacent the lower ends thereof, and said second beam extends between said second pair of posts adjacent the lower ends thereof;

(c) said at least two parallel joists are lower parallel joists; and (d) each of said apertures receives a portion of one of said lower parallel joists;

said structure for bearing weight further comprising:

(a) a third generally horizontal beam extending between a pair of said plurality of posts, adjacent the upper ends thereof, and intersecting the sidewalls of said pair of posts between which said third beam extends;

(b) a fourth generally horizontal beam extending between a pair of said plurality of posts, adjacent the upper ends thereof, and intersecting the sidewalls of said pair of posts between which said fourth beam extends, said third beam and said fourth beam being coplanar and horizontally spaced;

(c) at least two parallel, spaced, coplanar upper joists, dimensioned and configured to operatively support a bed mattress, each of said upper joists being supported by both of said third beam and said fourth beam;

(d) a third generally horizontal, hollow, elongated support member positioned parallel to and adjacent said third beam and extending between and abutting said pair of posts between which said third beam extends, said third support member having a sidewall, at least one of said sidewall of said third support member and said sidewalls of said pair of posts between which said third support member extends providing a third group of at least two apertures, each aperture of said third group of apertures receiving a portion of one of said upper joists to allow said one of said upper joists to be supported at least in part by said third beam;

(e) a fourth generally horizontal, hollow, elongated support member positioned parallel to and adjacent said fourth beam and extending between and abutting said pair of posts between which said fourth beam extends, said fourth support member having a sidewall, at least one of said sidewall of said fourth support member and said sidewalls of said pair of posts between which said fourth support member extends providing a fourth group of at least two apertures, each aperture of said fourth group of apertures receiving a portion of one of said upper joists to allow said one of said upper joists a portion of which is received by said aperture of said fourth group of apertures to be supported at least in part by said fourth beam;

(f) third retaining means for retaining said third support member in rigid contact with said pair of posts between which said third support member extends; and (g) fourth retaining means for retaining said fourth support member in rigid contact with said pair of posts between which said fourth support member extends.

23. The structure for bearing weight of claim 22, wherein:

(a) said third support member surrounds at least a portion of said third beam member;

(b) said fourth support member surrounds at least a portion of said fourth beam member;

(c) said sidewall of said third support member and said sidewall of said fourth support member each have an inner surface; and (d) said third beam and said fourth beam each have an upper surface;

said structure for bearing weight further comprising:

(a) a first spacer block extending from said inner surface of said sidewall of said third support member to said upper surface of said third beam, said first spacer block intersecting at least one of the sidewalls of said pair of posts between which said third support member extends, said first spacer block being to limit the radial movement of said third support member relative to said third beam; and (b) a second spacer block extending from said inner surface of said sidewall of said fourth support member to said upper surface of said fourth beam, said second spacer block intersecting at least one of the sidewalls of said pair of posts between which said fourth support member extends, said second spacer block being to limit the radial movement of said fourth support member relative to said fourth beam.

24. A structure for bearing weight, comprising:

(a) a plurality of generally vertical, horizontally spaced, tubular, elongated support posts, each of said posts having a sidewall;

(b) a first generally horizontal beam extending between a first pair of said plurality of posts and intersecting the sidewalls thereof, said first beam having a pair of ends;

(c) a second generally horizontal beam extending between a second pair of said plurality of posts and intersecting the sidewalls thereof, said second beam having a pair of ends, said first beam and said second beam being parallel to each other, horizontally spaced and lying in a generally horizontal plane;

(d) an elongated weight distribution member positioned beneath each end of said first beam, in contact therewith and parallel thereto to support at least a portion of the weight thereof, and an elongated weight distribution member positioned beneath each end of said second beam, in contact therewith and parallel thereto to support at least a portion of the weight thereof, each of said weight distribution members in contact with said first beam intersecting the sidewall of at least one of said first pair of posts, and each of said weight distribution members in contact with said second beam intersecting the sidewall of at least one of said second pair of posts;

(e) at least two parallel, spaced, coplanar joists, each of said joists being supported by both of said first beam and said second beam, said at least two joists lying in a plane which is generally parallel to said generally horizontal plane in which said first beam and said second beam lie;

(f) a first generally horizontal, tubular, elongated support member positioned parallel to and adjacent said first beam, said first beam being external to said first support member and said first support member overlaying at least a portion of said first beam and extending between and abutting said first pair of posts, said first support member having a sidewall, at least one of said sidewall of said first support member and said sidewalls of said first pair of posts providing a first group of at least two apertures, each aperture of said first group of apertures receiving a portion of one of said joists to allow said one of said joists to be supported at least in part by said first beam;

(g) a second generally horizontal, tubular, elongated support member positioned parallel to and adjacent said second beam and extending between and abutting said second pair of posts, said second support member having a sidewall, at least one of said sidewall of said second support member and said sidewalls of said second pair of posts providing a second group of at least two apertures, each aperture of said second group of apertures receiving a portion of one of said joists to allow said one of said joists a portion of which is received by said aperture of said second group of apertures to be supported at least in part by said second beam;

(h) a first strap which circumscribes said first support member and said first pair of posts, said first strap for retaining said first support member in rigid contact with said first pair of posts; and (i) a second strap which circumscribes said second support member and said second pair of posts, said second strap for retaining said second support member in rigid contact with said second pair of posts.

25. The structure for bearing weight of claim 24, wherein said at least two joists are dimensioned and configured to operatively support a bed mattress.

26. The structure for bearing weight of claim 25, wherein:

(a) each of said plurality of posts has a lower end and an upper end;

(b) said first beam extends between said first pair of posts adjacent the lower ends thereof, and said second beam extends between said second pair of posts adjacent the lower ends thereof;

(c) said at least two parallel joists are lower parallel joists; and (d) each of said apertures receives a portion of one of said lower parallel joists;

said structure for bearing weight further comprising:

(a) a third generally horizontal beam extending between a pair of said plurality of posts, adjacent the upper ends thereof, and intersecting the sidewalls of said pair of posts between which said third beam extends;

(b) a fourth generally horizontal beam extending between a pair of said plurality of posts, adjacent the upper ends thereof, and intersecting the sidewalls of said pair of posts between which said fourth beam extends, said third beam and said fourth beam being parallel to each other, horizontally spaced and lying in a generally horizontal plane;

(c) at least two parallel, spaced, coplanar upper joists, dimensioned and configured to operatively support a bed mattress, each of said upper joists being supported by both of said third beam and said fourth beam, said at least two upper joists lying in a plane which is generally parallel to said generally horizontal plane in which said third beam and said fourth beam lie;

(d) a third generally horizontal, tubular, elongated support member positioned parallel to and adjacent said third beam and extending between and abutting said pair of posts between which said third beam extends, said third support member having a sidewall, at least one of said sidewall of said third support member and said sidewalls of said pair of posts between which said third support member extends providing a third group of at least two apertures, each aperture of said third group of apertures receiving a portion of one of said upper joists to allow said one of said upper joists to be supported at least in part by said third beam;

(e) a fourth generally horizontal, tubular, elongated support member positioned parallel to and adjacent said fourth beam and extending between and abutting said pair of posts between which said fourth beam extends, said fourth support member having a sidewall, at least one of said sidewall of said fourth support member and said sidewalls of said pair of posts between which said fourth support member extends providing a fourth group of at least two apertures, each aperture of said fourth group of apertures receiving a portion of one of said upper joists to allow said one of said upper joists a portion of which is received by said aperture of said fourth group of apertures to be supported at least in part by said fourth beam;

(f) a third strap which circumscribes said third support member and said pair of posts between which said third support member extends, said third strap for retaining said third support member in rigid contact with said pair of posts between which said third support member extends; and (g) a fourth strap which circumscribes said fourth support member and said pair of posts between which said fourth support member extends, said fourth strap for retaining said fourth support member in rigid contact with said pair of posts between which said fourth support member extends.

27. The structure for bearing weight of claim 26, wherein:

(a) said third support member surrounds at least a portion of said third beam member;

(b) said fourth support member surrounds at least a portion of said fourth beam member;

(c) said sidewall of said third support member and said sidewall of said fourth support member each have an inner surface; and (d) said third beam and said fourth beam each have an upper surface;

said structure for bearing weight further comprising:

(a) a first spacer block extending from said inner surface of said sidewall of said third support member to said upper surface of said third beam, said first spacer block intersecting at least one of the sidewalls of said pair of posts between which said third support member extends, said first spacer block being to limit the radial movement of said third support member relative to said third beam; and (b) a second spacer block extending from said inner surface of said sidewall of said fourth support member to said upper surface of said fourth beam, said second spacer block intersecting at least one of the sidewalls of said pair of posts between which said fourth support member extends, said second spacer block being to limit the radial movement of said fourth support member relative to said fourth beam.

28. A structure for bearing weight, comprising:

(a) a plurality of generally vertical, horizontally spaced, tubular, elongated support posts, each of said posts having a sidewall;

(b) a first generally horizontal beam extending between a first pair of said plurality of posts and intersecting the sidewalls thereof, said first beam having a pair of ends;

(c) a second generally horizontal beam extending between a second pair of said plurality of posts and intersecting the sidewalls thereof, said second beam having a pair of ends, said first beam and said second beam being parallel to each other, horizontally spaced and lying in a generally horizontal plane;

(d) an elongated weight distribution member positioned beneath each end of said first beam, in contact therewith and parallel thereto to support at least a portion of the weight thereof, and an elongated weight distribution member positioned beneath each end of said second beam, in contact therewith and parallel thereto to support at least a portion of the weight thereof, each of said weight distribution members in contact with said first beam intersecting the sidewall of at least one of said first pair of posts, and each of said weight distribution members in contact with said second beam intersecting the sidewall of at least one of said second pair of posts;

(e) at least two parallel, spaced, coplanar joists, each of said joists being supported by both of said first beam and said second beam, said at least two joists lying in a plane which is generally parallel to said generally horizontal plane in which said first beam and said second beam lie;

(f) a first generally horizontal, tubular, elongated support member positioned parallel to and adjacent said first beam, said first support member surrounding at least a portion of said first beam and extending between and abutting said first pair of posts, said first support member having a sidewall, at least one of said sidewall of said first support member and said sidewalls of said first pair of posts providing a first group of at least two apertures, each aperture of said first group of apertures receiving a portion of one of said joists to allow said one of said joists to be supported at least in part by said first beam;

(g) a second generally horizontal, tubular, elongated support member positioned parallel to and adjacent said second beam and extending between and abutting said second pair of posts, said second support member having a sidewall, at least one of said sidewall of said second support member and said sidewalls of said second pair of posts providing a second group of at least two apertures, each aperture of said second group of apertures receiving a portion of one of said joists to allow said one of said joists a portion of which is received by said aperture of said second group of apertures to be supported at least in part by said second beam;

(h) a first strap which circumscribes said first support member and said first pair of posts, said first strap for retaining said first support member in rigid contact with said first pair of posts; and (i) a second strap which circumscribes said second support member and said second pair of posts, said second strap for retaining said second support member in rigid contact with said second pair of posts.

29. The structure for bearing weight of claim 28, wherein said at least two joists are dimensioned and configured to operatively support a bed mattress.

30. The structure for bearing weight of claim 29, wherein:

(a) each of said plurality of posts has a lower end and an upper end;

(b) said first beam extends between said first pair of posts adjacent the lower ends thereof, and said second beam extends between said second pair of posts adjacent the lower ends thereof;

(c) said at least two parallel joists are lower parallel joists; and (d) each of said apertures receives a portion of one of said lower parallel joists;

said structure for bearing weight further comprising:

(a) a third generally horizontal beam extending between a pair of said plurality of posts, adjacent the upper ends thereof, and intersecting the sidewalls of said pair of posts between which said third beam extends;

(b) a fourth generally horizontal beam extending between a pair of said plurality of posts, adjacent the upper ends thereof, and intersecting the sidewalls of said pair of posts between which said fourth beam extends, said third beam and said fourth beam being parallel to each other, horizontally spaced and lying in a generally horizontal plane;

(c) at least two parallel, spaced, coplanar upper joists, dimensioned and configured to operatively support a bed mattress, each of said upper joists being supported by both of said third beam and said fourth beam, said at least two upper joists lying in a plane which is generally parallel to said generally horizontal plane in which said third beam and said fourth beam lie;

(d) a third generally horizontal, tubular, elongated support member positioned parallel to and adjacent said third beam and extending between and abutting said pair of posts between which said third beam extends, said third support member having a sidewall, at least one of said sidewall of said third support member and said sidewalls of said pair of posts between which said third support member extends providing a third group of at least two apertures, each aperture of said third group of apertures receiving a portion of one of said upper joists to allow said one of said upper joists to be supported at least in part by said third beam;

(e) a fourth generally horizontal, tubular, elongated support member positioned parallel to and adjacent said fourth beam and extending between and abutting said pair of posts between which said fourth beam extends, said fourth support member having a sidewall, at least one of said sidewall of said fourth support member and said sidewalls of said pair of posts between which said fourth support member extends providing a fourth group of at least two apertures, each aperture of said fourth group of apertures receiving a portion of one of said upper joists to allow said one of said upper joists a portion of which is received by said aperture of said fourth group of apertures to be supported at least in part by said fourth beam;

(f) a third strap which circumscribes said third support member and said pair of posts between which said third support member extends, said third strap for retaining said third support member in rigid contact with said pair of posts between which said third support member extends; and (g) a fourth strap which circumscribes said fourth support member and said pair of posts between which said fourth support member extends, said fourth strap for retaining said fourth support member in rigid contact with said pair of posts between which said fourth retaining means extends.

31. The structure for bearing weight of claim 30, wherein:

(a) said third support member surrounds at least a portion of said third beam member;

(b) said fourth support member surrounds at least a portion of said fourth beam member;

(c) said sidewall of said third support member and said sidewall of said fourth support member each have an inner surface; and (d) said third beam and said fourth beam each have an upper surface;

said structure for bearing weight further comprising:

(a) a first spacer block extending from said inner surface of said sidewall of said third support member to said upper surface of said third beam, said first spacer block intersecting at least one of the sidewalls of said pair of posts between which said third support member extends, said first spacer block being to limit the radial movement of said third support member relative to said third beam; and (b) a second spacer block extending from said inner surface of said sidewall of said fourth support member to said upper surface of said fourth beam, said second spacer block intersecting at least one of the sidewalls of said pair of posts between which said fourth support member extends, said second spacer block being to limit the radial movement of said fourth support member relative to said fourth beam.

32. A kit of parts for constructing a structure for bearing weight, comprising:

(a) a plurality of hollow, elongated support posts, each of said posts having a sidewall, and adapted to be directed upwardly;

(b) a first beam adapted to be positioned generally horizontally, and further adapted to extend between a first pair of said plurality of posts and intersect the sidewalls thereof, said first beam having a pair of ends;

(c) a second beam adapted to be positioned generally horizontally, and further adapted to extend between a second pair of said plurality of posts and intersect the sidewalls thereof, said second beam having a pair of ends, said first beam and said second beam being further adapted to be positioned in a coplanar manner and horizontally spaced;

(d) at least two joists adapted to be positioned parallel to and spaced from one another in a coplanar manner, each of said joists being adapted to be supported by both of said first beam and said second beam;

(e) a first hollow, elongated support member adapted to be positioned generally horizontally and parallel to and adjacent said first beam and further adapted to extend between and abut said first pair of posts, said first support member having a sidewall, at least one of said sidewall of said first support member and said sidewalls of said first pair of posts providing a first group of at least two apertures, each aperture of said first group of apertures being adapted to receive a portion of one of said joists to allow said one of said joists to be supported at least in part by said first beam;

(f) a second hollow, elongated support member adapted to be positioned generally horizontally and parallel to and adjacent said second beam and flusher adapted to extend between and abut said second pair of posts, said second support member having a sidewall, at least one of said sidewall of said second support member and said sidewalls of said second pair of posts providing a second group of at least two apertures, each aperture of said second group of apertures being adapted to receive a portion of one of said joists to allow said one of said joists a portion of which is received by said aperture of said second group of apertures to be supported at least in part by said second beam;

(g) a first strap adapted to circumscribe said first support member and said first pair of posts, for retaining said first support member in rigid contact with said first pair of posts; and (h) a second strap adapted to circumscribe said second support member and said second pair of posts, for retaining said second support member in rigid contact with said second pair of posts.

33. A structure for bearing weight, comprising:

(a) at least two spaced upwardly directed, hollow elongated posts, each of said posts having a sidewall;

(b) a generally horizontal beam intersecting the sidewall of each of said posts;

(c) a joist, supported at least in part by said beam;

(d) a generally horizontal, hollow, elongated support member positioned parallel to and adjacent said beam and abutting said posts, said support member having a sidewall, at least one of the sidewall of said support member and said sidewall of each of said posts providing an aperture to receive a portion of said joist to allow said joist to be supported at least in part by said beam, said support member surrounding at least a portion of said beam; and (e) a retaining means for retaining said support member in rigid contact with said posts.

34. The structure for bearing weight of claim 33, wherein said posts and said support member are tubular.

35. The structure for bearing weight of claim 33, wherein said posts is generally vertical.

36. The structure for bearing weight of claim 33 further comprising an elongated weight distribution member positioned beneath said beam, in contact therewith and parallel thereto to support at least a portion of the weight thereof, said weight distribution member intersecting the sidewall of each of said posts.

37. The structure for bearing weight of claim 36, wherein said beam and said weight distribution member are integral.

38. The structure for bearing weight of claim 33, wherein said sidewall of said support member has an inner surface, and wherein said beam has an upper surface, said structure for bearing weight further comprising a spacer block extending from said inner surface of said sidewall of said support member to said upper surface of said beam, said spacer block intersecting the sidewall of each of said posts, and said spacer block being to limit the radial movement of said support member relative to said beam.

39. The structure for bearing weight of claim 33, wherein said sidewall of each of said posts, is intersected twice by said beam.

* * * * *